United States Patent [19]

Hirabayashi et al.

[11] Patent Number: 5,026,276

[45] Date of Patent: Jun. 25, 1991

[54] IMAGE FIXING APPARATUS USING A DETACHABLE FILM

[75] Inventors: Hiromitsu Hirabayashi, Yokohama; Kensaku Kusaka, Kawasaki; Morikazu Mizutani, Tokyo, all of Japan

[73] Assignee: Canon Kabushiki Kaisha, Tokyo, Japan

[21] Appl. No.: 426,082

[22] Filed: Oct. 24, 1989

[30] Foreign Application Priority Data

| | | | |
|---|---|---|---|
| Oct. 24, 1988 | [JP] | Japan | 63-267679 |
| Oct. 24, 1988 | [JP] | Japan | 63-267680 |
| Nov. 11, 1988 | [JP] | Japan | 63-285541 |
| Dec. 13, 1988 | [JP] | Japan | 63-315334 |
| Dec. 21, 1988 | [JP] | Japan | 63-324504 |

[51] Int. Cl.[5] ..... G03G 15/20

[52] U.S. Cl. ..... 432/59; 219/216; 355/286; 355/282

[58] Field of Search ..... 355/282, 284, 286; 219/216, 388; 432/59, 60

[56] References Cited

U.S. PATENT DOCUMENTS

| | | | |
|---|---|---|---|
| 3,578,797 | 5/1971 | Hodges et al. | 263/3 |
| 3,810,735 | 5/1974 | Moser | 432/59 |
| 3,811,828 | 5/1974 | Ohta et al. | 432/59 X |
| 4,531,823 | 7/1985 | DeGuchi et al. | 355/308 |
| 4,575,221 | 3/1986 | Onoda et al. | 355/3 R |
| 4,609,276 | 9/1986 | Mitzutani | 355/3 R |
| 4,780,742 | 10/1988 | Takahashi et al. | 355/290 |

*Primary Examiner*—R. L. Moses

*Attorney, Agent, or Firm*—Fitzpatrick, Cella, Harper & Scinto

[57] ABSTRACT

An image fixing apparatus includes a heating source for heating a toner image; a film movable in contact with a member for supporting the toner sheet, wherein the toner image is heated by heat from the heating source through the film; and a casing forming, together with the film, a cartridge detachably mountable into the apparatus.

50 Claims, 14 Drawing Sheets

IMAGE FIXING APPARATUS USING A DETACHABLE FILM

FIELD OF THE INVENTION AND RELATED ART

The present invention relates to an image fixing apparatus for fixing a toner image formed on an image supporting member, usable with an image forming apparatus such as an electrophotographic machine or an electrostatic recording apparatus.

In a conventional image fixing apparatus wherein the toner image is fixed on the recording medium, the recording medium is passed through a nip formed between a heating roller maintained at a predetermined temperature and a pressing or back-up roller having an elastic layer and press-contacted to the heating roller, the recording medium supporting an unfixed toner image.

In the heat-roller fixing apparatus, the temperature of the heating roller must be controlled very precisely. If the temperature of the heating roller is low, the toner will not sufficiently soften with the result of low temperature off-set, and if, on the contrary, the temperature of the heating roller is high, the toner will be is completely fused with the result of decreased toner coagulation force, and therefore, high temperature off-set is produced.

U.S. Pat. No. 3,578,797 proposes a solution to the high temperature off-set and the low temperature off-set by fusing the toner by way of a web, wherein the heating position and the separating position is different. U.S. Ser. No. 206,767 which has been assigned to the assignee of this application proposes a fixing apparatus using a heat resistive sheet wherein the heating position and the separating position is different. Where, however, the web or the sheet are used, the fixed image deteriorates when the web or the sheet is creased. If it occurs the web or the sheet has to be exchanged, but the exchanging operation is cumbersome.

SUMMARY OF THE INVENTION

Accordingly, it is a principal object of the present invention to provide an image fixing apparatus wherein a sheet or a film contactable with the toner image can be easily exchanged.

It is another object of the present invention to provide an image fixing apparatus wherein the film is constituted as a cartridge.

It is a further object of the present invention to provide an image fixing apparatus wherein the image fixing property can be changed by exchanging the film.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
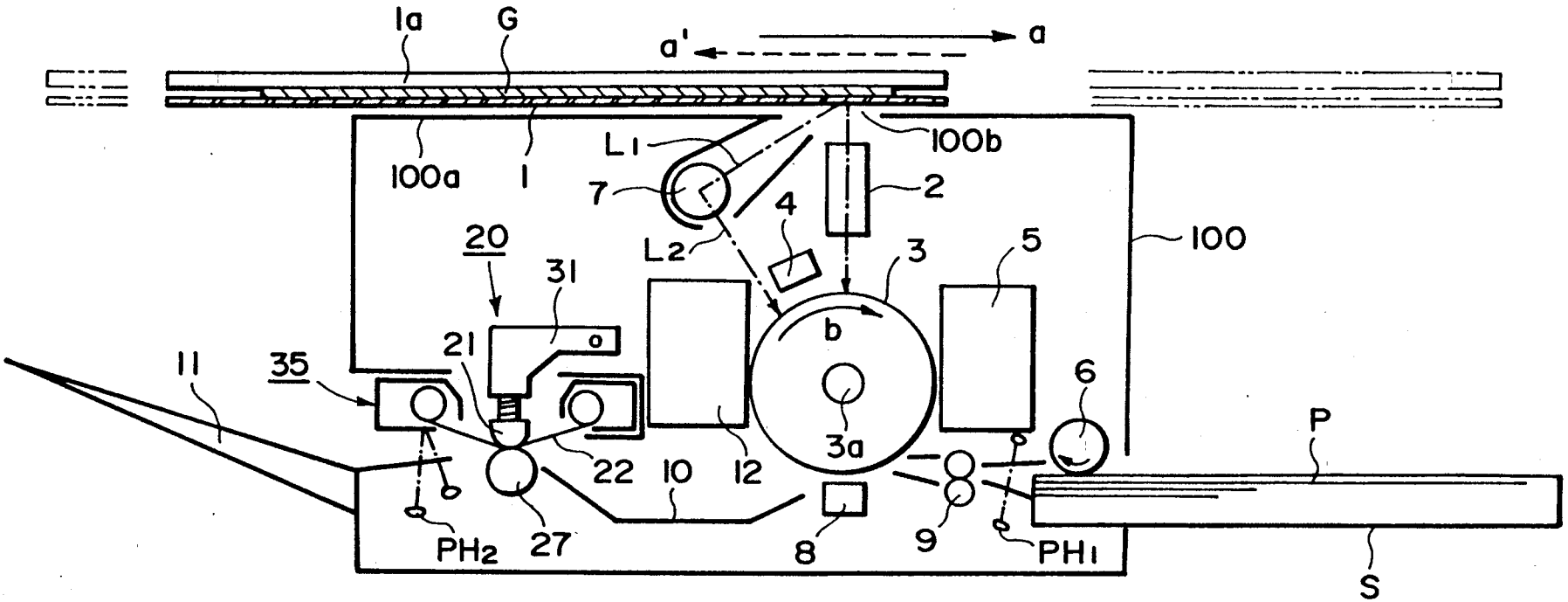
FIG. 1 is a sectional view of an image forming apparatus incorporating an image fixing apparatus according to an embodiment of the present invention.

The preferred embodiments of the present invention will be described in detail in conjunction with the accompanying drawings wherein like reference numerals are assigned to the elements having the corresponding functions.

Referring to FIG. 1, there is shown an image forming apparatus of an electrophotographic type using the fixing apparatus according to an embodiment of the present invention, in a cross-section. It comprises a casing 100, a reciprocable original supporting platen made of transparent material such as glass disposed in a top plate 100*a* of the casing. The original supporting platen 1 is reciprocated at a predetermined speed rightwardly a and leftwardly a' on the top plate 100*a*.

An original G is placed face down on the top plate of the original supporting platen 1 at a predetermined reference position, and an original pressing plate 1*a* is pressed to the original.

The apparatus has a slit opening 100*b* extending in a direction perpendicular to the reciprocating direction of the original supporting platen 1 (perpendicular to the sheet of the drawing). The surface of the original G facing down sequentially passes by the slit opening 100*b* from the right side to the left side in the rightward stroke a of the reciprocating movement. During the passage, light L1 from a lamp 7 is projected to the original G through the slit opening 100*b* and the transparent original supporting platen 1. The light reflected by the surface of the original is imaged on a surface of a photosensitive drum 3 by a short focus small diameter imaging element array 2.

The photosensitive drum 3 is coated with a photosensitive layer made of zinc oxide photosensitive layer or organic photoconductor photosensitive layer and is rotatable in the clockwise direction b at a predetermined peripheral speed about a center shaft 3*a*. During the rotation, the photosensitive member is uniformly charged by a charger 4 to a positive or negative polarity. The charged surface is exposed to the imaged light through the slit from the original image, by which an electrostatic latent image is sequentially formed on the photosensitive drum 3 surface, corresponding to the original image.

The electrostatic latent image thus formed is sequentially developed by a developing device 5 with toner made of resin which is softened or fused by heat. The toner image is advanced to an image transfer station comprising a transfer charger 8.

Sheets of transfer material P which is a recording medium supporting the toner image are stacked and accommodated in a cassette S. The sheet in the cassette is picked up by a pickup roller 6. The sheet is then fed by a registration roller 9 in such a timed relation that when the leading edge of the toner image on the drum 3 reaches the transfer charger 8, the leading edge of the transfer sheet P reaches a position between the transfer charger 8 and the photosensitive drum 3. The unfixed toner image is transferred from the photosensitive drum 3 to the sheet by the transfer charger 8.

The sheet having received the toner image at the transfer station is sequentially separated from the surface of the photosensitive drum 3 by an unshown separating means, and is guided along a conveyance guide G to an image fixing device 20 which will be described hereinafter. The fixing device heat-fixes the toner image, and the sheet is discharged to a discharge tray 11 outside the apparatus as an image product (copy).

On the other hand, the surface of the photosensitive drum 3 after the toner image is transferred is cleaned by a cleaning device 12, so that the residual toner or other foreign matter is removed therefrom. Then, the drum 3 is subjected to the electric discharging operation by whole surface exposure L2, by which the electric residual memory is erased to permit repetitive image forming operation.

Designated by reference characters PH1 and PH2 are a sheet detecting sensor (photosensor, for example) disposed in the sheet passage between the pick-up roller 6 and the registration roller 9, and a discharge sheet detecting sensor (photosensor, for example) disposed after the fixing device 20, respectively.

The description will be made as to the fixing device 20 in this embodiment.

Figure 2:
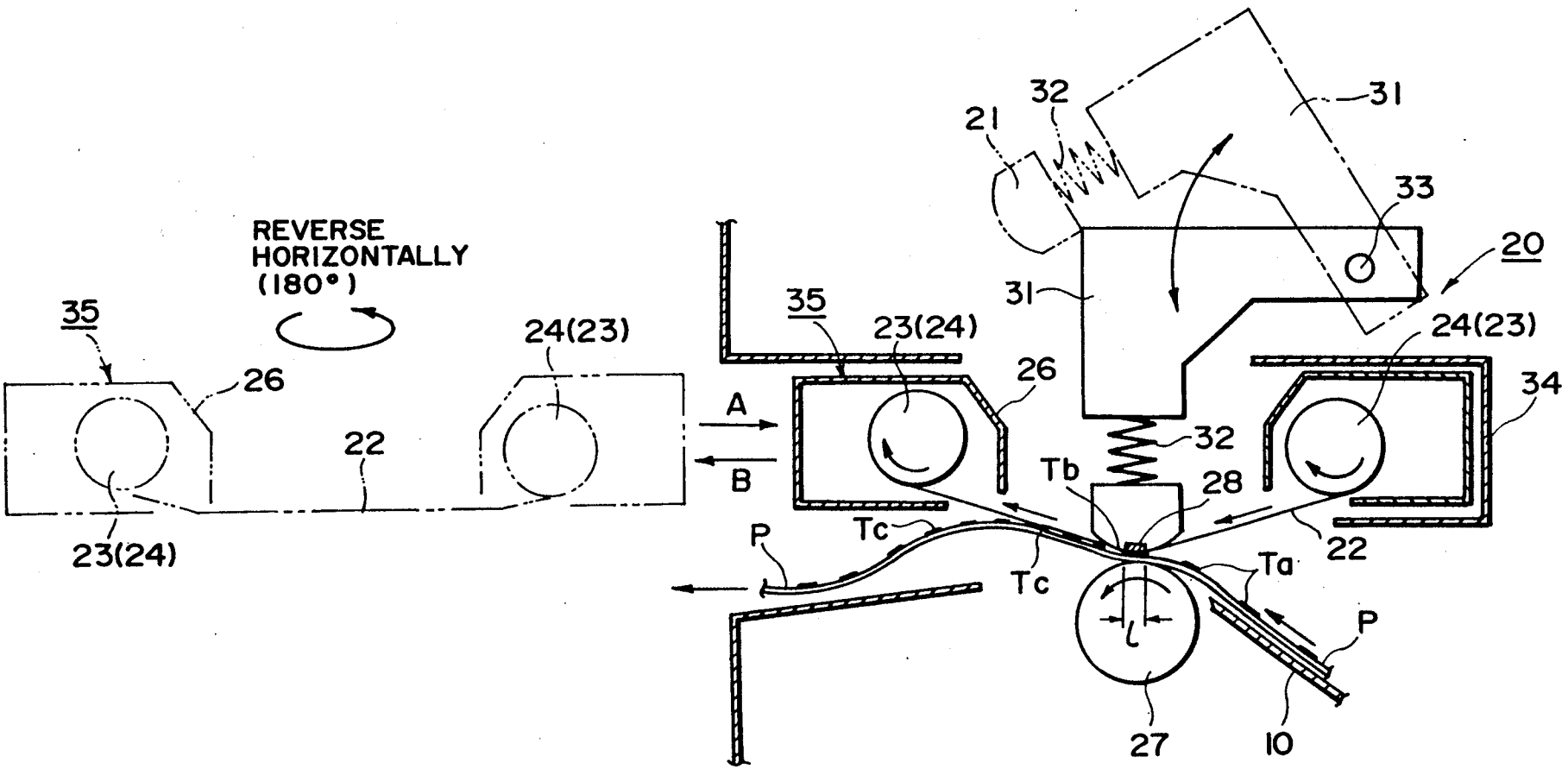
FIG. 2 is an enlarged view of an image fixing apparatus according to the embodiment wherein the image fixing operation is being performed.

FIG. 2 is an enlarged view of the fixing device 20, wherein the fixing device is shown as being executing the fixing operation. The fixing device includes a fixing film supply shaft 24 on which fixing film 22 having a predetermined length is rolled, and a take-up shaft 23 to which the leading edge of the fixing film 22 is fixed. The fixing film 22 is a thin long film made of plastic resin, which in this embodiment is PET (polyester) having a thickness of 6 micron with heat-resistive treatment.

The fixing device further comprises a heating member 21 and a pressing roller 27, which are faced or contacted to the top side and the bottom side of the fixing film between the shafts 24 and 23, respectively. The pressing roller 27 includes a core made of metal or the like and an elastic layer thereon made of silicone rubber or the like.

The take-up shaft 23 is rotationally driven in the clockwise direction by an unshown driving system, by which the fixing film 22 is moved from the supply shaft 24 side to the take-up shaft 23 side in the same direction as and at the same speed as the sheet P conveyed to the fixing device 20 along the guide 10 from the image forming station (transfer station 8). The pressing roller 27 is rotationally driven in the counterclockwise direction at the peripheral speed substantially the same as the conveying speed of the sheet P, by an unshown driving system.

The heating member 21 includes an electrically insulative and heat-resistive material such as alumina or a compound material containing it, and a heat generating surface (layer) 28 in the form of a line or stripe, made of $Ta_2N$, for example, having a width of 160 microns and a length of 216 mm in the direction perpendicular to the sheet of the drawing, formed on the bottom surface of the base material. The heating member 21 further includes a protection layer for protection from the sliding movement made of $Ta_2O_5$, for example, on the heat generating surface 28. The bottom surface of the heater 21 is smooth and is rounded at the leading and trailing ends to permit smooth sliding movement relative to the fixing film 22.

The heat generating surface 28 of the heater member 21 has a small thermal capacity, and is pulsewisely energized, by which the temperature thereof is instantaneously increased up to approximately 200° C. for each pulse energization.

The heating member 21 is supported on a supporting arm 31 rotatable about a shaft 33 substantially vertically. The supporting arm 31 is urged by a spring 32. The supporting arm 31 is rotated in the counterclockwise direction about the shaft 33 to a first position wherein the heating member 21 faces down, as shown by solid lines. At this position, the heating member 21 is retained at this position by an unshown locking means, by which the bottom surface of the heating member 21 and the top surface of the pressing roller 27 are urged toward each other through the fixing film 22 or through the fixing film 22 and the sheet P (recording material) with a predetermined pressure, which is 4–6 kg, for example, in total pressure for A4 width, for example. The supporting arm 1 is rotatable, when the locking means is released, to a second position indicated by chain lines in the clockwise direction. In the second position, the heating member 21 is released from urging relative to the pressing roller 22, and therefore, it takes an upper position.

Figure 3:
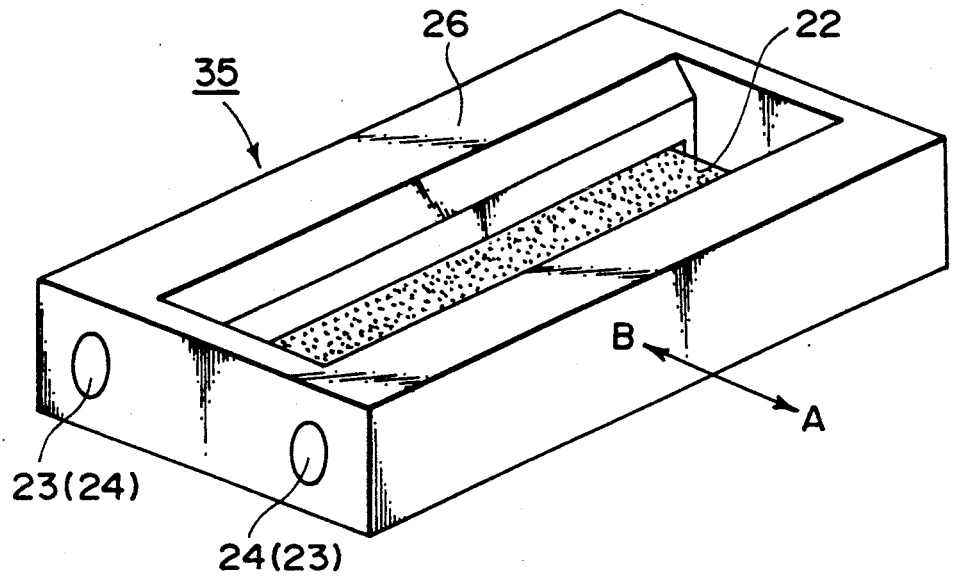
FIG. 3 shows a perspective appearance of the fixing film cartridge according to the embodiment of the present invention.

In this embodiment, the supply shaft 24 having a roll of the fixing film 22, and the take-up shaft 23 are constituted as a fixing film cartridge 35 which is detachably mountable to a predetermined position of the fixing device 20 as a unit. The film cartridge 35 is provided with an outer casing 26 containing the above elements 22, 23 and 24. FIG. 3 shows an outer appearance of the film cartridge 35.

The image forming apparatus is provided with a cartridge receiving portion 34 having an opening in a side thereof. When the cartridge 35 is to be mounted or dismounted, the supporting arm 31 of the heating member 21 is moved to the second position indicated by the chain lines to remove the heating member 21 from the cartridge receiving portion 34, and then the cartridge 35 is inserted sufficiently into the cartridge receiving portion 34 in a direction A, or it is pulled out in the opposite direction B. After the cartridge 35 is mounted in the image forming apparatus, the supporting arm 31 taking the second position is moved back to the first position indicated by the solid lines, by which the bottom surface of the heating member 21 is urged to the top surface of the pressing roller 27 through the fixing film 22. The take-up shaft 23 and the supply shaft 24 of the cartridge 35 are provided with respective driving gear (not shown). When the cartridge 35 is sufficiently inserted into the cartridge receiving portion 34 with the supply shaft side leading, the driving gear for the take-up shaft 23 is brought into meshing engagement with a driving gear (not shown) of the driving system in the image fixing device, so that the take-up shaft 23 can be driven. The supply shaft 24 is rotatable with slight braking force to provide proper tension to the fixing film 22 traveled to the take-up shaft 23.

The driving gears for the take-up shaft 23 and the supply shaft 24 are of the same configuration, and therefore, when the cartridge 35 is reversely inserted into the receiving portion 34, the driving gear for the supply shaft 24 is brought into meshing engagement with the driving gear of the driving system of the image fixing apparatus, which will be described hereinafter.

The description will be made as to operation of the image forming apparatus incorporating the image fixing device of this embodiment. The original G is placed on the original supporting platen 1, and the various setting operations are carried out for the number of image forming operations, the size of the sheet P used, the magnification and others. Then, when the image formation start switch is depressed, the pick-up roller 9 feeds the sheet P from the cassette S, and the sheet is detected by the sensor PH1. Also, the image formation on the photosensitive drum 3 is started. In the fixing device 20, the driving system thereof starts to rotate the take-up shaft 23 and the pressing roller 27 at the time when a predetermined period of time elapses from the point of time at which the sensor PH1 detects the sheet, that is, at the time when the time period required for the sheet P fed out of the cassette S to passes the registration roller couple 9, the transfer station 8 and the guide 10 and for its leading edge to reach the vicinity of the nip between the heating member 21 and the pressing roller 27, elapses. By this, the fixing film 22 is supplied from the supply shaft 24 to the take-up shaft 23 at the same speed as the sheet conveyance speed. The heat generating surface 28 of the heating member 21 is energized or deenergized at proper timing on the basis of detections of the leading edge and trailing edge of the sheet P. In this regard, the energization of the heat generating surface may be controlled using position detection of the sheet by a sheet sensor of the image forming apparatus.

The top surface of the sheet supporting the unfixed toner image Ta conveyed to the fixing device 20 is contacted to the bottom surface of the film 22 which is moving, and the sheet is passed through the nip between the heating member 21 and the pressing roller 27 together with the fixing film 22 without rubbing or creasing. During the passage through the nip, the unfixed toner image on the recording material surface is heated and softened or fused by the heating member through the fixing film. Particularly, the surface portion thereof is heated far above the toner fusing point to completely soften or fuse the toner. At this time, the heating member, the fixing film, the toner image and the recording material are pressed by the pressing member in the nip between the heating member and the pressing member, so that the heat is efficiently transferred, and therefore, the toner is sufficiently softened or fused by a short period heating. Therefore, the fixing performance is good. On the other hand, the temperature rise of the recording material is practically very small so that the wasteful consumption of the thermal energy is small. In other words, the recording material itself is practically not heated, and only the toner is efficiently heated and softened or fused. Therefore, the toner image can be heated and fixed with small power consumption.

Here, the state of the toner referred to in this specification will be described. The toner fusing point used here means the minimum temperature required for fixing the toner and covers the case where the viscosity thereof decreases to such an extent as can be set to be fused, at the minimum fixable temperature and the case where the viscosity decreases to such an extent as can be said to be softened, at the minimum fixable temperature. Therefore, even when it is said that the toner is fused for convenience, it actually may mean the viscosity decrease to such an extent that it is actually softened. Similarly, when it is said that the toner is cooled and solidified for convenience, it actually may not be solidified depending on the materials of the toner, but can be said that the viscosity is sufficiently increased.

In the heating process of this embodiment, the heating member 21 is provided with a linear heat generating surface 28 having a low thermal capacity and formed integrally with the heating member 21 is pulsewisely energized to repeat the heat generation. The toner image Ta on the sheet P being conveyed at a speed Vp (mm/sec) is introduced into the effective width 1 (FIG. 2) of the linear heating portion defined by the width of the heat generating surface 28 of the heating member 21 together with the fixing film 22 moved at a speed corresponding to the sheet conveyance speed without deviation, by which the toner image is softened or fused to be a softened or fused image Tb.

The portion of the sheet having passed through the nip between the heating member 21 and the pressing roller 27 is advanced while being closely contacted to the fixing film, for a while.

The period in which the sheet is being contacted with the film after the heating process constitutes a cooling step by which the heat of the toner softened or fused in the heating step is radiated so that the toner is cooled or solidified. By the cooling or solidification, the coagulation force of the toner becomes so large that it behaves as a mass, and simultaneously, the adhesiveness and the fixing tendency to the recording material is increased, while the adhesiveness and the fixing tendency relative to the fixing film decreases. The toner is pressed to the recording material by the pressing member when it is heated and softened or fused during the heating step, and therefore, at least a part of the image soaks to the surface layer of the recording sheet. The cooling and solidification of the soaked part provides an anchoring effect to increase the adhesion of the cooled or solidified toner to the recording material.

After the toner image is cooled or solidified by the cooling step, the recording material is sequentially separated from the surface of the fixing film. By the time of the separation, the toner image is sufficiently cooled or solidified to provide sufficiently strong adhesive or fixing force, while the force to the fixing film is very small. Therefore, the portion of the recording material having been subjected to the image fixing operation is sequentially and easily separated without production of the toner offset to the fixing film.

As described above, the recording material to be subjected to the image fixing operation is advanced at the same speed as the fixing film while being contacted thereto in the manner that the unfixed toner image side of the sheet is contacted to the fixing film; the toner image is heated and fused by the heating member through the fixing film; and the recording material and the fixing film are separated after the toner image is cooled or solidified. Therefore, the toner offset to the fixing film is not produced; a heat generating element having a small thermal capacity can be used; the power supply to the heat generating element can be carried out with a simple structure; the toner image can be efficiently heated to a temperature sufficiently higher than the temperature required for the toner to be fixed (fusing point or softening point); the fixing operation is possible with small amount of energy without improper fixing; as a result, the waiting period for the use of the apparatus, the power consumption and the temperature increase inside the apparatus can be reduced.

As described hereinbefore, since the adhesive or fixing force of the toner to the sheet P is sufficiently large and the force to the fixing film 22 is small, the sheet P is easily separated from the fixing film 22, or it is easily separated by an unshown separating means. The separation is possible practically without the toner offset to the film 22.

The movement of the fixing film 22 by the take-up shaft of the fixing device 20 is stopped when the trailing edge of the sheet P is detected by the discharge sheet detecting sensor PH2 after the sheet P passes through the fixing apparatus 20.

In the apparatus of this embodiment, the fixing film 22 is supplied from the supply shaft 24 to the take-up shaft 23 at the same speed as the sheet P conveyance speed.

It is possible that the control of the forward drive of the fixing film is performed without use of the discharge sheet detecting sensor PH2 by starting the drive after a predetermined first timer period elapses from the point of time when the sheet detecting sensor PH1 detects the sheet and by stopping it after a second timer period elapses.

In this embodiment, the linear heat generating surface 28 of the heating member 21 is instantaneously heated by the energization up to a temperature sufficiently above the toner fusing point (or the fixable temperature), and therefore, it is not necessary to keep power supply during a stand-by state to maintain the predetermined temperature.

Therefore, the heat transfer to the pressing roller 27 is small when the fixing operation is not performed. Also, during the fixing operation, the fixing film, the toner image and the sheet are between the heating member 21 and the pressing roller 27, and the temperature gradient is steep because the heat generating period is short, and therefore, the pressing roller 27 is not easily heated so that the temperature thereof is maintained lower than the toner fusing point even when the practically continuous image formation is performed in the apparatus of this embodiment having the structure described above, the toner image made of heat-fusible toner on the sheet P first heated and fused by the heating member 21 through the fixing film 22. Particularly, the surface portion thereof is completely softened or fused. At this time, the pressing roller 26 presses the heating member, the fixing film, the toner image and the sheet to transfer the heat efficiently. Therefore, the heating of the sheet P itself can be minimized, while the toner image can be efficiently heated and fused. Particularly, by limiting the energy supply heat generation period, the energy consumption can be saved.

The size of the heating member may be small, and therefore, the thermal capacity is small with the advantage of unnecessity of pre-heating the heating member. This can reduce the power consumption when the image forming operation is not performed, and the temperature rise inside the apparatus can be prevented.

In this embodiment, the temperature of the pressing roller 27 is as described hereinbefore.

By reversing the cartridge 35, the positional relation of the film take-up shaft 23 and the supply shaft 24 of the cartridge 35 in the cartridge receiving portion is reversed, by which the driving gear (not shown) of the supply shaft 27 is engaged with a driving gear (not shown) of the driving system, by which the supply shaft then functions as a take-up shaft, and the take-up shaft 23 functions as a supply shaft. By this, the fixing film taken up of the take-up shaft 23 is supplied to the supply shaft 24 for each of the image fixing operations. Thus, the fixing film is reused.

The cartridge reversing may be repeated until the service life of the fixing film ends, and therefore, the operation cost is decreased.

Figure 4:
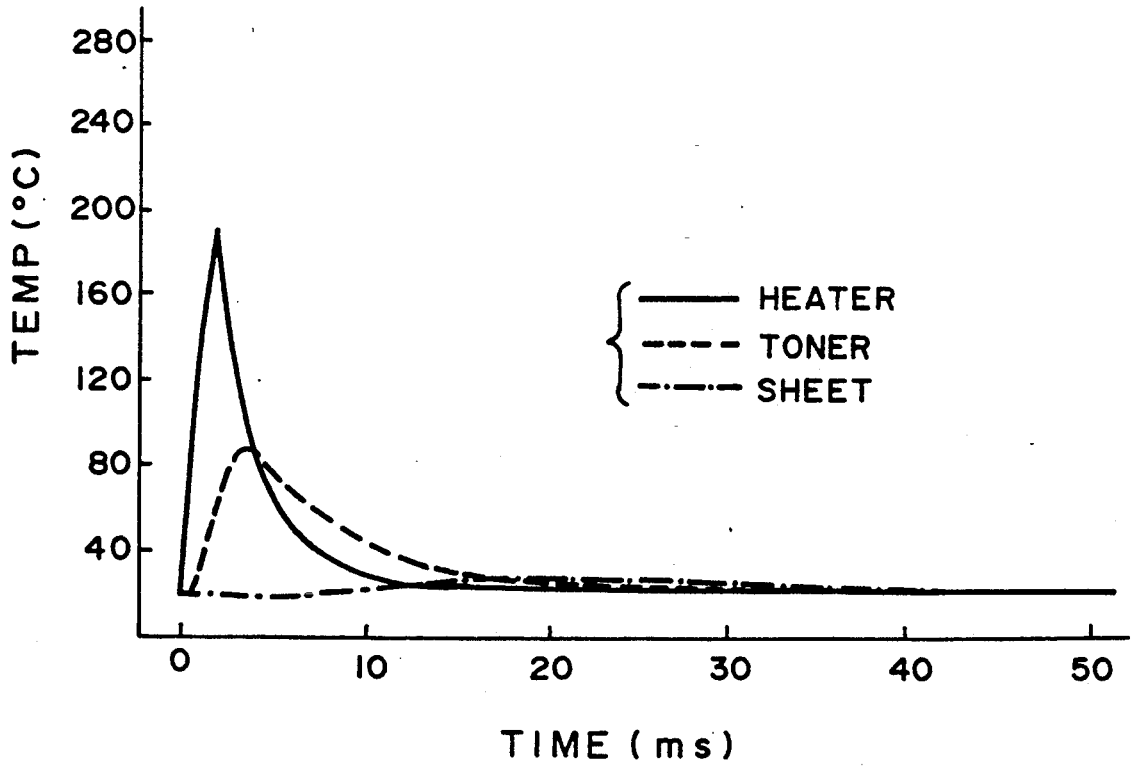
FIG. 4 is a graph showing the temperature change in the embodiment of FIG. 2.

Referring to FIG. 4, there is shown a change of temperature, with time, of the toner and the temperature of the transfer sheet, more particularly, the thickness center of the transfer sheet when the transfer sheet having the toner layer on the surface thereof is subjected to the fixing operation while it is being conveyed in the fixing device of the image forming apparatus according to this embodiment. The temperatures are obtained by calculation under the following conditions:

Heating condition: heating for 2 ms with energy density of 15 W/mm

Toner fixing temperature: 80° C.

Thickness of the toner layer: 20 microns

Fixing film: PET having a thickness of 6 microns

Thickness of the transfer sheet: 100 microns

Room temperature: 20° C.

In this embodiment, the temperature of the heat generating surface 28 of the heating member 21 is increased up to approximately 200° C. which is much higher than the toner fixing temperature which is 80° C., and therefore, the temperature of the toner exceeds beyond the fixing temperature by a short heating period (2 ms), so that it is sufficiently heated with good fixing property. On the other hand, the temperature rise of the transfer sheet is very small, and therefore, the waste of energy is small as compared with the conventional heating roller fixing.

In addition, even when excessive energy is supplied due to the variation in the heating period and/or the heating energy density, the high temperature toner offset is not produced, and therefore, the tolerable range of the heat control is wide.

An example of the fixing apparatus having the same structure as described above, but using another fixing film.

In this example, the fixing film is made of polyimide and have a thickness of 12.5 microns which exhibits better durability than the fixing film used in the foregoing embodiment (PET, 6 microns thickness). Therefore, it is repeatedly used for a longer period.

Figure 5:
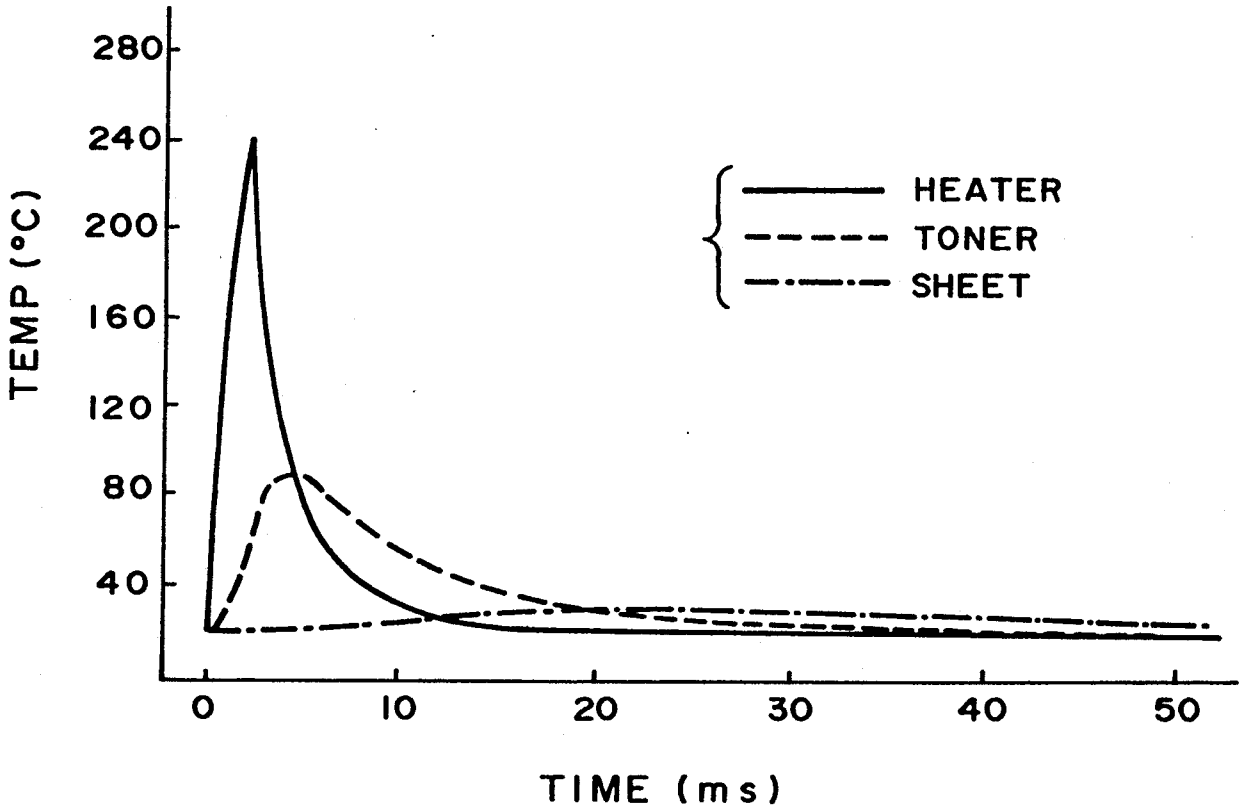
FIG. 5 is a graph showing the temperature change in an apparatus according to another embodiment of the present invention.

FIG. 5 shows the temperature changes, with time, of the toner and the transfer sheet, more particularly, the thickness center thereof when the transfer sheet having the toner layer on its surface is subjected to the fixing operation while it is being conveyed, using the polyimide film. The temperatures are obtained by calculation under the following conditions:

Heating condition: heating for 2 ms at the energy density of 20 W/mm
Toner fixing temperature: 80° C.
Toner layer thickness: 20 microns
Fixing film: polyimide having a thickness of 12.5 microns
Thickness of the transfer sheet: 100 microns
Room temperature: 20° C.

In this example, the temperature of the heat generating surface 28 of the heating member 21 is increased up to approximately 240° C. which is much higher than the toner fixing temperature which is 80° C., and therefore, the toner is sufficiently heated beyond the fixing temperature by the heating for the very short period (2 ms), and therefore, the good fixing properties can be provided.

Figure 6:
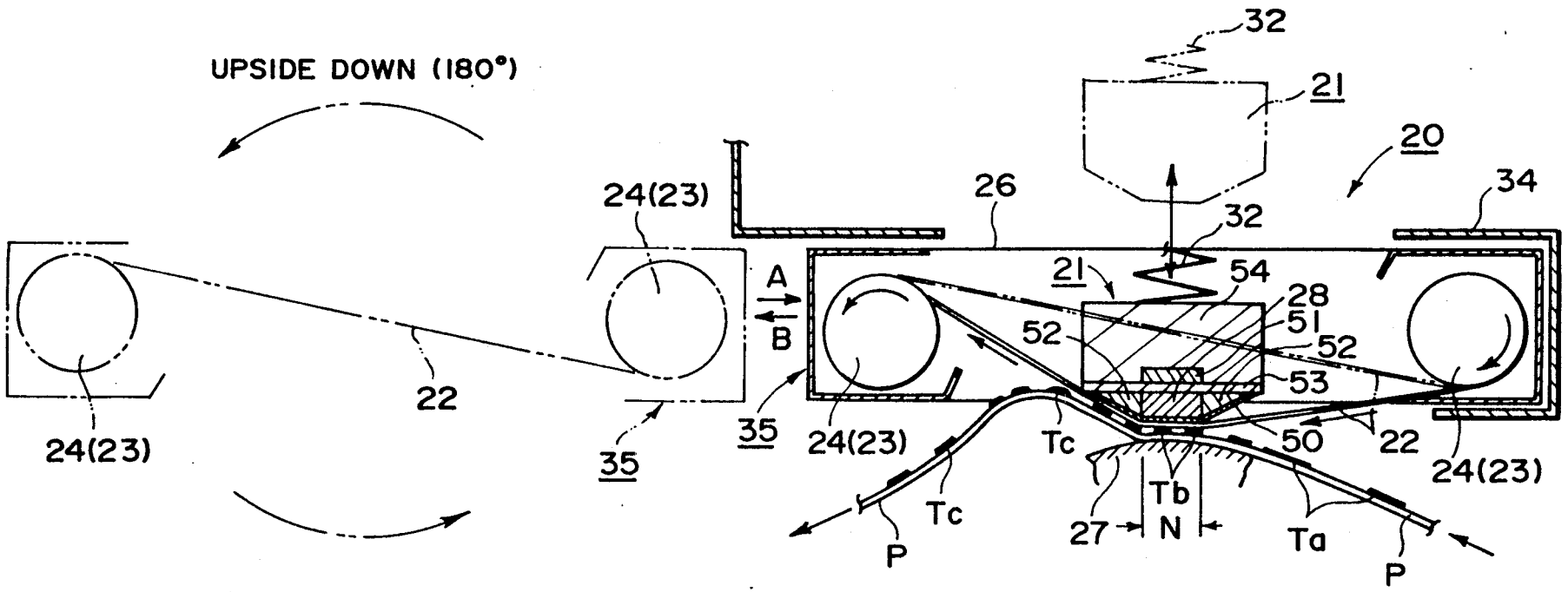
FIG. 6 is an enlarged view of the fixing apparatus according to a further embodiment of the present invention.

FIG. 6 shows an image fixing apparatus according to a further embodiment of the present invention. In this embodiment, the heating member 21 is a constant temperature heating member having the structure shown in FIG. 6 in cross-section. The constant temperature heating member includes a heat generating resistor 28 in the form of a line of stripe extended in a direction crossing the sheet conveyance direction and electrodes 52 at the opposite sides. The heat generating resistor 28 is made of $Ta_2N$, for example, and having a width of 160 microns, a length of 216 mm (measured in the direction perpendicular to the sheet of the drawing), for example. The surface thereof is coated with a protection layer 50 for protection from the sliding movement, and it is made of fluorine resin (PTFE, for example) or the like in the form of a film having a thickness of 5 microns. On the top surface of the heat generating resistor 28, a temperature detecting element 51 such as a thermister is disposed through an insulating layer 53. The power supply to the heat generating resistor 28 is controlled in accordance with the temperature detected by the element 51, by which the surface temperature of the heating member 21 at the fixing portion N (the convex heating width of 0.4 mm) is maintained at a predetermined temperature. Those members are securedly fixed by a heat generating member supporting member 54, which is made of material exhibiting heat insulation and electrical insulation, Bakelite, for example.

The fixing film cartridge 35 in this embodiment is reversible up side down relative to the cartridge receiving portion 34, and the fixing film 22 is stretched between the supply shaft 24 and the take-up shaft 23 in the form of a crossed belt. The front and back sides (first side and the second side) of the fixing film 22 have different fixing properties. By reversing the cartridge 35 up side down, the first side and the second side of the fixing film can be selectively used to permit selection of the image quality of the fixed image.

In the image forming apparatus according to this embodiment, the toner image is heated while it is contacted with the fixing film 22, thus softening or fusing the toner image, and after the toner image is cooled or solidified by spontaneous heat radiation or by forced cooling, the fixing film 22 and the toner image are separated. Therefore, the surface of the toner image after the image fixing film follows the surface property of the fixing film 22. In other words, if the surface of the fixing film 22 is smooth, the fixed toner image is glossy, on the other hand, if the surface of the fixing film 22 is rough, the fixed image is not glossy.

In this embodiment, the fixing film 22 has different surface conditions on the first and second sides, and either the first side or the second side is selectively used by turning over the cartridge 35, by which the image quality can be selected.

As for the fixing film 22, a polyimide film having a thickness of 12.5 microns is treated for the heat resistivity and for resistivity against the sliding movement. It has the surface property of not more than 0.5 s for providing glossy image, whereas the surface property of the second side is not less than 1 s for providing non-glossy image. The first and second side can be selectively used by reversing up side down the cartridge 35. When the apparatus is operated at the toner fixing temperature 125° C., the process speed of 50 mm/sec, and the heating member 21 is maintained at a predetermined pressure. Then, high quality glossy images were obtained when the first side of the film is used, and high quality non-glossy images were obtained when the second side was used.

Using the reversible cartridge of this type, both sides of the fixing film 22 are usable, thus further improving the cost reduction. The surface properties of these sides may be different or the same.

Figure 7:
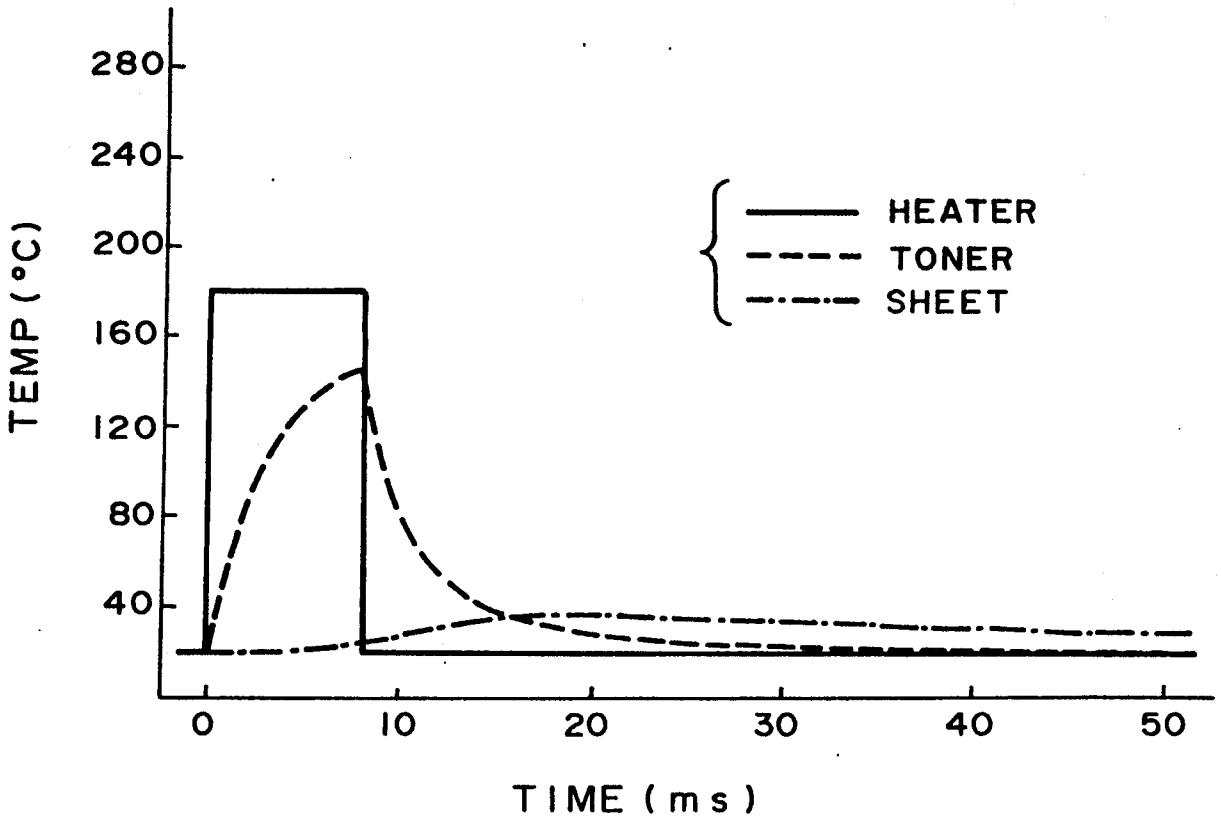
FIG. 7 is a graph showing the temperature change in the apparatus of FIG. 6 embodiment.

FIG. 7 shows temperature changes of the toner and the transfer sheet, more particularly, the thickness center thereof when the transfer sheets having the toner layer on its surface is subjected to the fixing operation while it is being conveyed. The temperature changes are obtained by calculation under the following conditions:

Heating conditions: heating for 8 ms by the linear heating member maintained at a constant temperature (180° C.)
Toner fixing temperature: 125° C.
Fixing film: PET having a thickness of 6 microns
Thickness of the toner layer: 20 microns
Thickness of the transfer sheet: 100 microns
Room temperature: 20° C.

In this embodiment, the toner is heated up to 180° C. which is much higher than the fixing temperature which is 125° C., and therefore it is sufficiently heated, thus providing good fixing property.

Similarly to the foregoing embodiments, the temperature rise of the transfer sheet is very small, and the wasteful consumption of the energy is smaller than in the conventional heat roller fixing apparatus.

In this embodiment, even when the toner is supplied with excessive energy due to variation of the heating period and the temperature of the heating member, the high temperature toner offset is not produced, and therefore, the tolerable range is wide.

The image fixing apparatuses described in the foregoing are suitable for an electrophotographic machine of an image transfer type. However, the fixing apparatus of the present invention is applicable to bias image forming apparatus is such as a copying machine, a laser beam printer, a facsimile machine, a microfilm reader/- printer, display apparatus or recording apparatus which may be of a direct type wherein the image forming process means directly forms a toner image on electrofax paper, electrostatic recording sheet or the like, or of another type wherein image formation process means of magnetic recording image forming type or another proper type forms an image of heat fusible toner on a recording material, which is heat-fixed.

Figure 8:
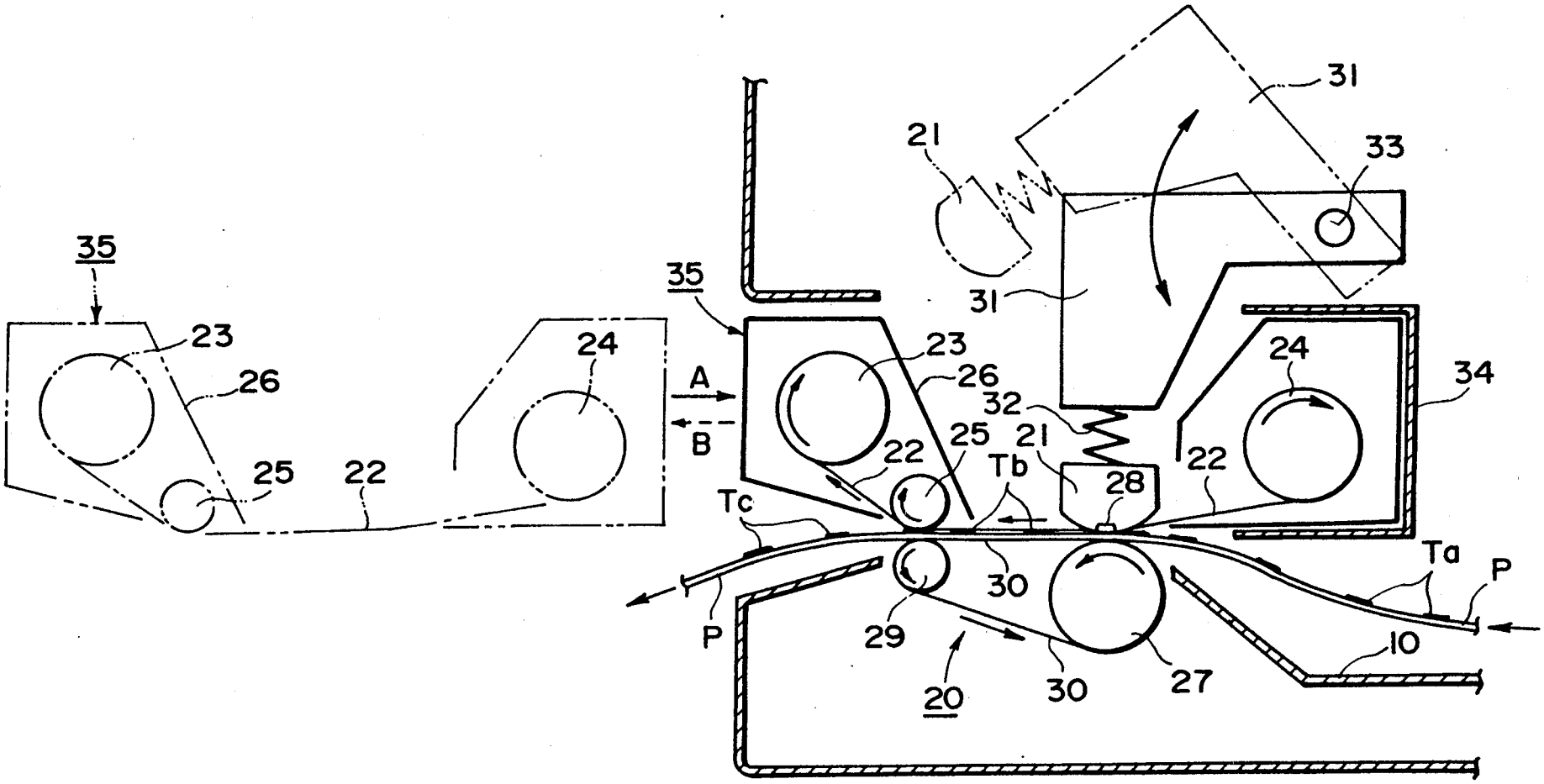
FIG. 8 is an enlarged view of an image fixing apparatus according to a further embodiment of the present invention wherein the image fixing operation is being performed.

Referring to FIG. 8, a further embodiment of the fixing apparatus will be described. The apparatus of this embodiment comprises, in addition to the structures shown in FIG. 2, a pair of separating rollers 25 and 29 and a conveying belt 30 stretched between the pressing roller 27 and a lower separating roller. Because of the provision of the conveying belt 30, the film is assuredly closely contacted to the toner image during the cooling step, and the fixing film is assuredly separated from the image supporting member by the provision of the pair of separating rollers.

Figure 9:
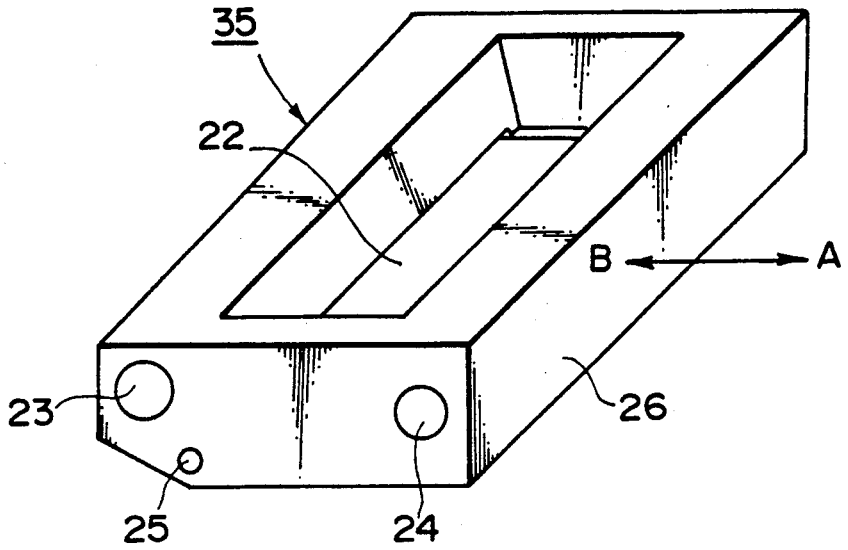
FIG. 9 shows a perspective appearance of the fixing film cartridge used in FIG. 8 embodiment.

FIG. 9 shows an outer appearance of the film cartridge in a perspective view. As shown in FIGS. 8 and 9, the upper separating roller 25 in addition to the film 22, the take-up and supply shaft 23 and 24, is constituted as the cartridge. Therefore, by removing the film cartridge, the entire sheet conveying passage of the fixing apparatus is opened.

Figure 10:
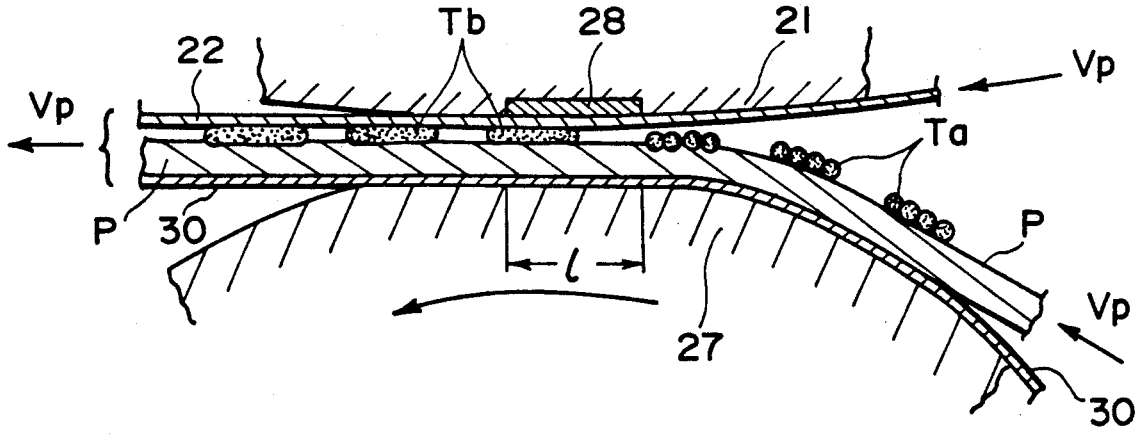
FIG. 10 is an enlarged view of a nip formed between the heating member and the pressing roller in FIG. 9 embodiment.

FIG. 10 is an enlarged view of the nip. The toner image Ta on the sheet P being conveyed at the conveying speed Vp (mm/sec) is introduced into the effective width 1 of the linear heating portion behind by the width of the heat generating surface 28 of the fixing member 21 together with the fixing film 22 moving at the speed corresponding to the conveying speed of the sheet P, and is heated to be softened or fused into a softened fused image Tb.

In the foregoing embodiment, the fixing property is changed by the first and second surfaces of the film having different surface roughness. In this embodiment, plural fixing film cartridge are prepared which contain fixing film having different surface conditions and which are exchangeable. In accordance with the desired image quality (glossy or non-glossy, for example), the operator selects a proper cartridge.

The fixing film 22 is advanced from the supply shaft 24 to the take-up shaft 23 for each of the fixing operations, and when all of the fixing film is taken up, it is replaced with a new fixing film. Alternatively, since practically no toner offset is produced to the fixing film, the used fixing film is rewound on the supply shaft 24 after it is taken up on the take-up shaft 23, or the take-up side and the supply side are exchanged if the thermal deformation or deterioration of the film is not significant, so that it is repeatedly used (rewinding and repeatedly using type). Further alternatively, it may be in the form of an endless belt. In the take-up and exchanging type, the material of the fixing film 22 may be a low cost polyester film which is treated for heat resistance. The thickness of the film can be reduced without regard to the durability, and therefore, the energy consumption can be reduced. When this type is used, it is preferable that an unshown remaining film amount detecting means is used to detect the remaining amount of the film, and when the remaining amount becomes small enough, warning display or sound is produced to promote the user to exchange the film.

In the rewinding repeatedly using type, the fixing film may be in a multi-layer film having a polyimide resin film, as the base material, having a thickness of 25 microns and having good heat resistivity and mechanical strength or the like and a releasing layer made of fluorine resin or the like having a high releasing property. During the rewinding operation, it is preferable that the urging of the pressing roller 27 to the heating member 21 is released.

When the film is repeatedly used as in the rewinding and repeatedly using type or in the endless belt type, a felt pad for cleaning the film surface may be provided which may contain a small amount of releasing agent such as silicone oil and which is contacted to the film surface to improve the cleaning and releasing property for the film surface. In addition, where the fixing film is treated with an insulating fluorine resin material, electrostatic charge is easily deposited on the film and disturbs the toner image. To obviate this problem, it may be electrically discharged by a discharging brush which is grounded. In place of the grounding, the brush may be supplied with a bias voltage to charge the film to such an extent that the toner image is not disturbed. Another solution to the problem is to add conductive powder or fibers such as carbon black into the fluorine resin to prevent the image disturbance by the electric charge. The same measures are applicable to the pressing roller to remove the electric charge or to make it conductive. In addition anti-electrification agent may be applied or added.

In any types, the fixing film 22 may be in the form of a cartridge detachably mountable at a predetermined position in the fixing apparatus 20, by which the fixing film exchanging operation is made easier.

The structure of the heating member 21 and the power supply control to the heat generating surface (layer) 28 are not limited to those described above. For example, in place of the heat generating surface 28 of the heating member, a thick film resistor or a chip array made of ceramic material having PTC property may be used. The power supply control is not limited to the pulsewise power application, but the power may be always supplied. However, it is preferable that the heat generating portion of the heating member and the heating portion thereof for heating the toner are integrally formed and are securedly fixed.

Figure 11:
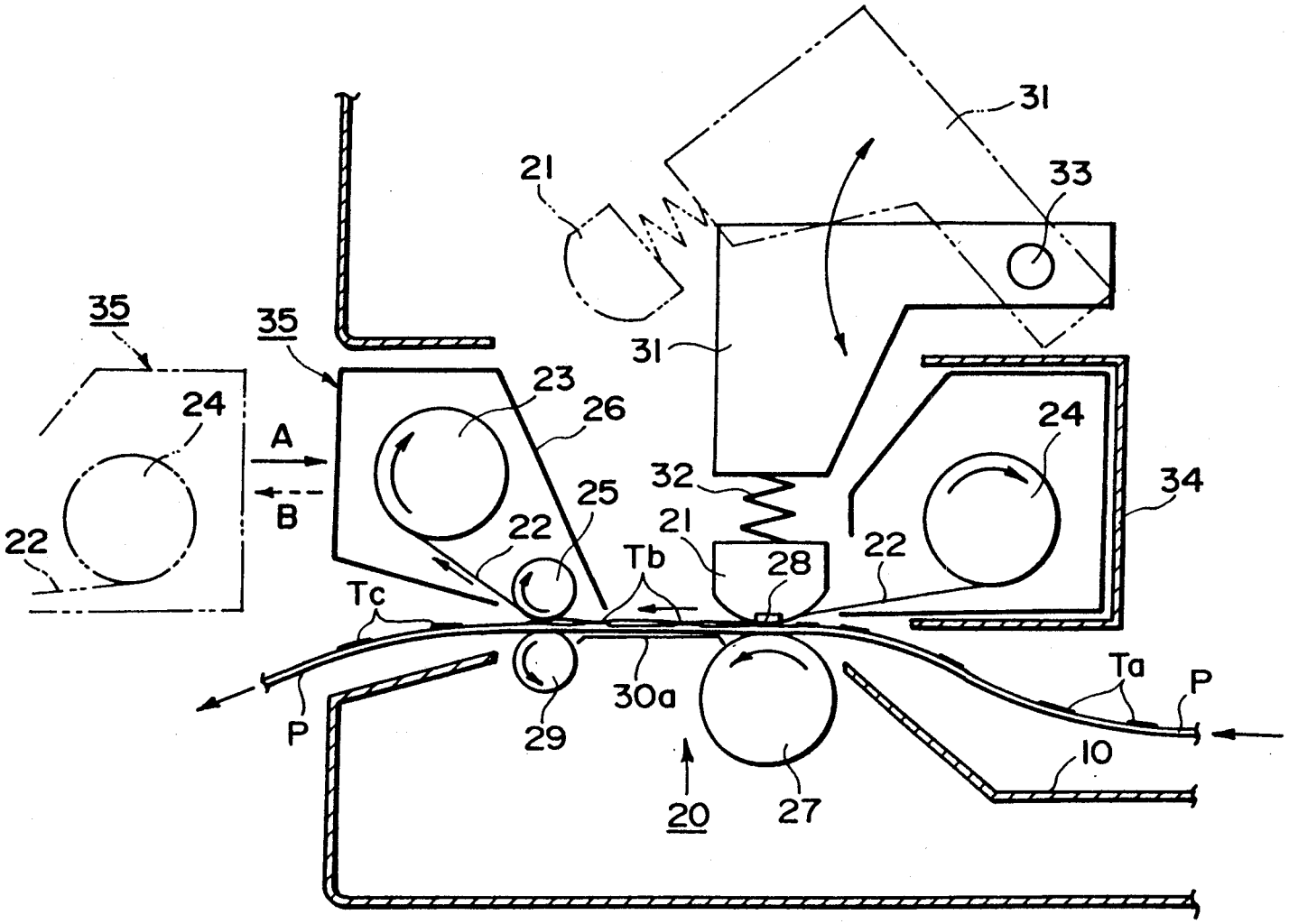
FIG. 11 is a sectional view of an image fixing apparatus according to a further embodiment of the present invention.

FIG. 11 shows an image fixing apparatus according to a further embodiment wherein the film is rewound and used. This embodiment is different from FIG. 8 embodiment in that the conveying belt 30 is not used, but in place thereof, a guiding plate **30*a* is disposed closely faced to the bottom surface of the fixing film 22 between the pressing roller 22 and the lower separating roller 29, in that the fixing film 22 is made of polyimide having good heat resistivity and mechanical strength which is treated for resistance against the sliding movement and for the releasing property, having a thickness of 12.5 microns since the fixing film is 22 is repeatedly usable, and in that the take-up shaft 23 and the supply shaft (rewinding shaft) 24 of the fixing film cartridge 35** are provided with driving gears (not shown) at longitudinal ends thereof.

When the fixing film cartridge 35 is mounted in the cartridge receiving portion 34 of the apparatus, the driving gears of the shafts 23 and 24 of the cartridge 35 are securedly coupled with the driving system of the apparatus by an unshown gear coupler mechanism in the apparatus.

Figure 12:
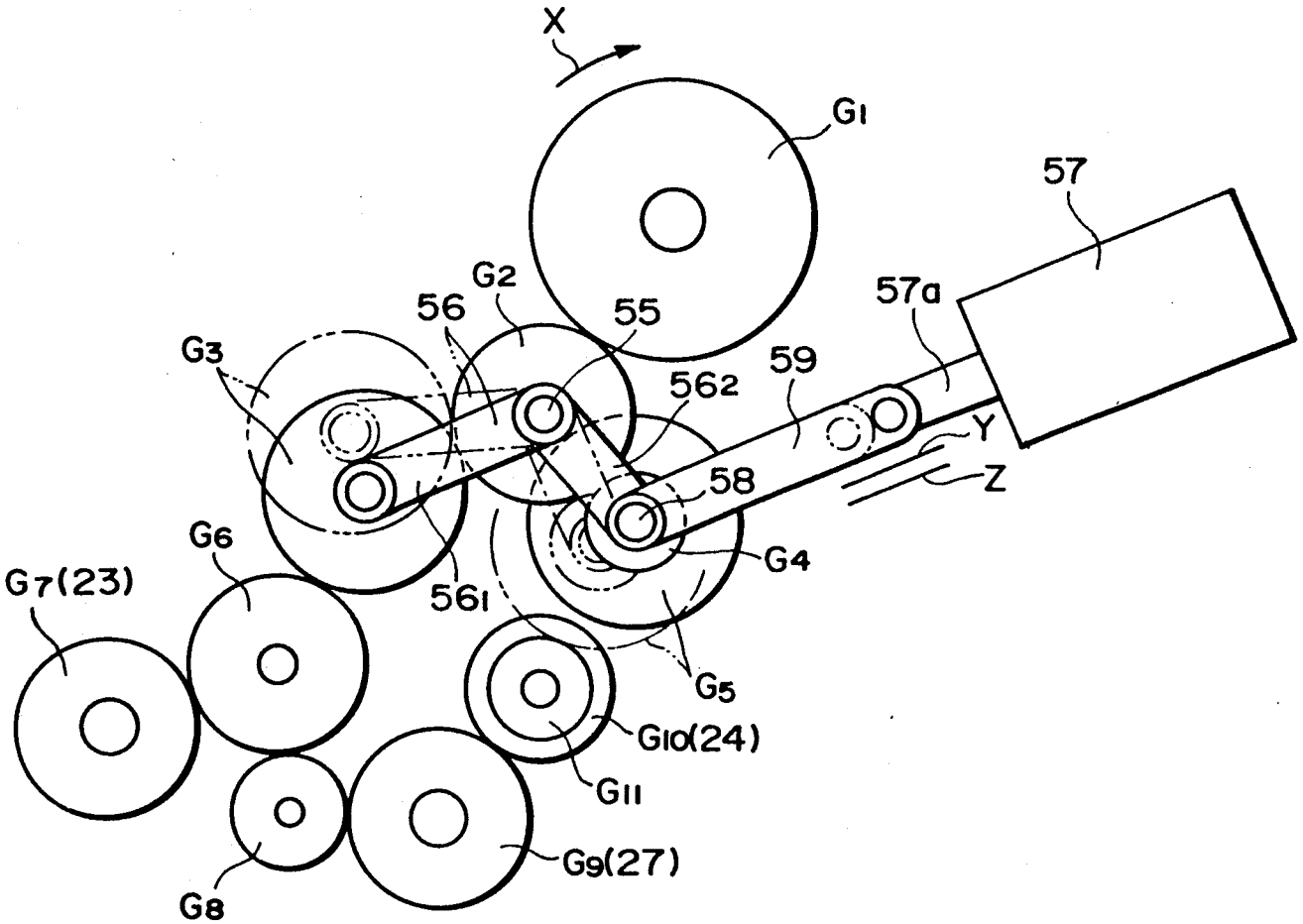
FIG. 12 shows a gear train of a driving system used in FIG. 11 embodiment.

FIG. 12 shows gear trains of the driving system for rotating the take-up shaft 23 of the fixing film cartridge 35 in the take-up direction, for rotating the supply shaft 24 in the rewinding direction and for rotating the pressing roller 27 in the forward and backward directions.

The gear train includes a first gear G1 functioning as a driving gear which is stopped and driven at a predetermined peripheral speed in the clockwise direction X by an unshown driving source, a second gear G2 meshed with the first gear and third and fourth gears functioning as planetary gears associated with the second gear G2. The third and fourth gears are supported on a first arm $56_1$ and a second arm $56_2$ of a lever 56 which is rotatably supported on a shaft 55 of the second gear G2, and are meshed with the second gear G2. A fifth gear G5 is coaxial and integral with the fourth gear G4. A sixth gear G6 is selectively engageable with the third gear G3. Seven and eighth bears G7 and G8 are meshed with the sixth gear G6. Ninth and tenth gears G9 and G10 are sequentially meshed with the eighth gear G8. A eleventh gear G11 is coaxial and integral with the tenth gear G10. To the gear G11, the fifth gear G5 is selectively engageable.

The seventh gear G7, the ninth gear G9 and the tenth gear G10 functions as driving gears for the takeup shaft 23, the pressing roller 27 and the supply shaft (rewinding shaft) 24, respectively. An electromagnetic solenoid 57 has a retractable plunger 57*a*. An end of the plunger 57*a* and a central shaft 58 of the fourth gear G4 supported on the second arm $56_2$ of the lever 56 are coupled by a link 59.

By the retracting movement Y of the plunger 57*a*, the lever 56 is rotated in the counterclockwise direction about the shaft 55, by which the third gear G3 is brought into meshing engagement with the sixth gear G6 as shown by solid lines, so that the fifth gear G5 is disengaged from the eleventh gear G11. This constitute a first position.

When the plunger 57*a* advances Z, the lever 56 rotates in the clockwise direction about the shaft 55 by which the third gear G3 is disengaged from the sixth gear G6 as shown by chain lines, and the fifth gear G5 is brought into meshing engagement with the eleventh gear G11. This constitutes a second position.

The plunger 57*a* is normally maintained at the retracted position Y, and therefore, the gear train is maintained in the first position indicated by the solid lines. When the first gear G1 is rotated in the clockwise direction X in the first position of the gear train, the driving force is transmitted from the gear G2—the gear G3—the gear G6—the gear G7 to rotate the take-up shaft 57 forward. The rotational force of the gear G6 is transmitted to the gear G9 through the gear G8 to rotate the pressing roller 27 forward. Further, the rotational force of the gear G9 is transmitted to the gear G10 to rotate the supply shaft 24 forward. By the forward drives for the take-up shaft 23, the pressing roller 27 and the supply shaft 24, the fixing film 22 is moved forward from the supply shaft 24 side to the take-up shaft side at a predetermined speed (the same speed as the conveying speed of the sheet P to be fixed).

The seventh gear G7 for driving the take-up shaft 27 is coupled with the take-up shaft 23 through a slipping mechanism, by which the peripheral speed of the take-up shaft 23 is slightly larger than the peripheral speed of the pressing roller 27. Thus, the fixing film moved by the pressing roller 27 at the predetermined conveying speed is take-up under a predetermined tension provided by the slipping mechanism. The take-up shaft 23 is provided with a braking member in which the braking load is changeable by changing the pressure to a friction plate. During the film take-up operation, the braking load is reduced.

The tenth gear G10 for driving the supply shaft 24, similarly to the seventh gear G7, is coupled with the supply shaft 24 through a slipping mechanism, and is provided with a braking member to provide a larger braking load during the film rewinding operation to provide the fixing film with the tension. The rotational speed of the tenth gear G10 is so selected that the peripheral speed of the supply shaft 24 is larger than the peripheral speed of the pressing roller 27. However, the slipping mechanism operates by the braking force provided by the braking member, and the supply shaft 24 rotates following the speed at which the fixing film is conveyed by the pressing roller 27.

With the above-described structure, even if the fixing film 22 is a thin film in this embodiment, it is moved forward with proper tension force, and therefore, it can be rewound without production of crease.

When the plunger 57*a* is advanced to the position Z, the gear train is shifted to the second position as shown by the chain lines. When the first gear G1 is rotated in the clockwise direction X, the rotational driving force of the first gear G1 is transmitted through the second gear G2, the fourth gear G4 and the fifth gear G5 and through the gear G11—the gear G10—the gear G9—the gear G8—the gear G6—the gear G7 in the opposite direction from the direction during the film take-up operation. By this, the supply shaft 24, the pressing roller 27 and the take-up shaft 23 are rotated backward, by which the fixing film 22 is rewound from the take-up shaft 23 to the supply shaft 24, thus establishing the backward moving state.

The fourth and fifth gears G4 and G5 constitute a stepped gear having small diameter and large diameter portions, and the tenth and eleventh gears G10 and G11 constitute a stepped gear having a large diameter portion and the small diameter portion, correspondingly. Therefore, the rotational speed of the reverse rotation of the supply shaft 24, the pressing roller 27 and the take-up shaft 23 is larger than the forward rotational speed during the film rewinding operation, so that the film rewinding period is reduced. The braking load to the supply shaft 24 is larger, and the braking load to the take-up shaft 23 is larger. With this structure, he film can be rewound in this embodiment without production of the crease as in the film take-up operation, and in addition, the film can be rewound in a short period of time.

During the fixing operation, the fixing film 22 is continuously taken up as in the first embodiment, and is rewound when the fixing operation is not performed, so that it is repeatedly used.

By taking up and rewinding the fixing film repeatedly, the following advantage is provided. Even if the conveyance direction of the fixing is slightly deviated, or the crease tens to be easily produced due to precision of the parts such as the take-up shaft, the pressing roller, the heater or the supply shaft or due to the precision in the parallelism among them, the film is rewound by the same members as used in the take-up operation, so that the slight deviation is corrected each time. Therefore, the film travel is stabilized has compared with an endless belt type in which the deviation is accumulated with the higher tendency of crease production, so that the fixing film can be traveled stably for a long period of time. Therefore, a thin fixing film which is easy to produce the crease, and therefore, which is not good in the stability in the travel when used in an endless belt type can be repeatedly used for a long period of time, so that further reduction of energy consumption is accomplished.

Figure 13:
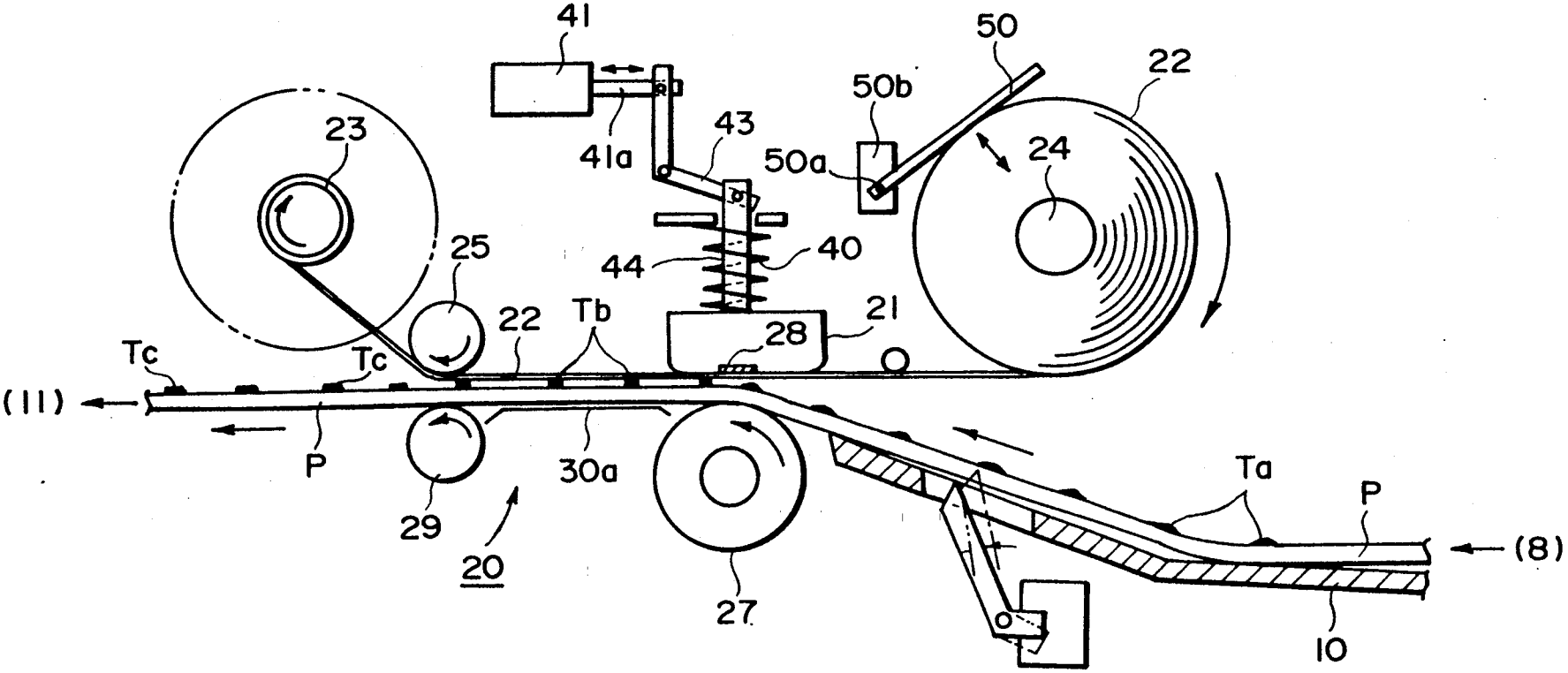
FIG. 13 is a sectional view of an image fixing apparatus according to a further embodiment of the present invention.

Referring to FIG. 13, a further embodiment will be described. In this embodiment, the fixing film is not in the form of a cartridge enclosed with a casing as in the foregoing embodiment. Rather, the supply shaft supporting a roll of fixing film 22 is detachably mounted on the bearing portion of the fixing apparatus 20, and the take-up shaft 23 for taking the fixing film 22 up is detachably mounted to the bearing of the fixing apparatus 20, by which the fixing film 22 is made detachably mountable. In this type, the percentage of the space occupied by the fixing film in the fixing apparatus 20 can be reduced, as compared with the cartridge type, so that the size of the fixing film which is exchangeable can be reduced, or the entire fixing apparatus can be reduced in size.

Figure 14:
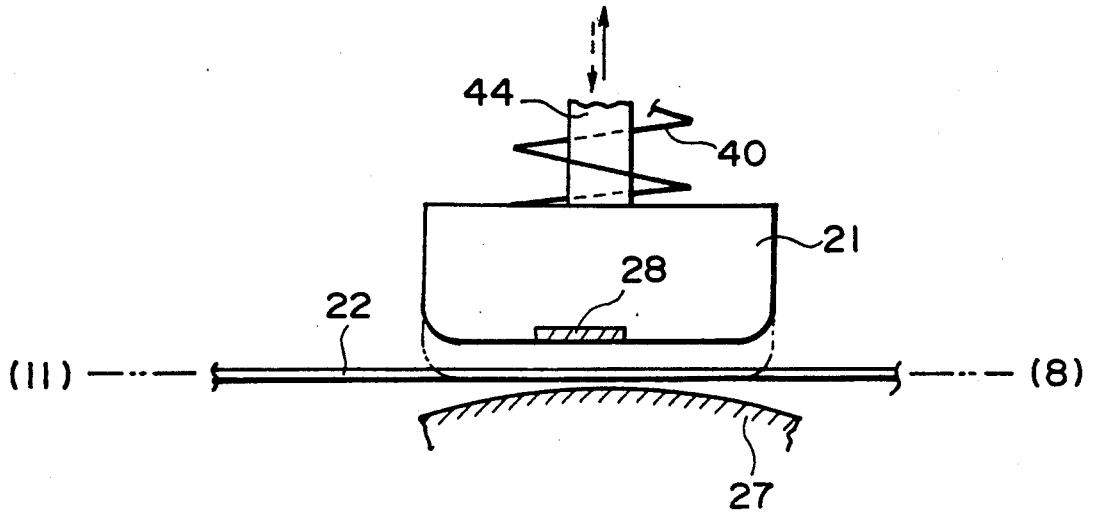
FIG. 14 illustrates pressure release between the heating member and the pressing roller in FIG. 13 embodiment.
Figure 15:
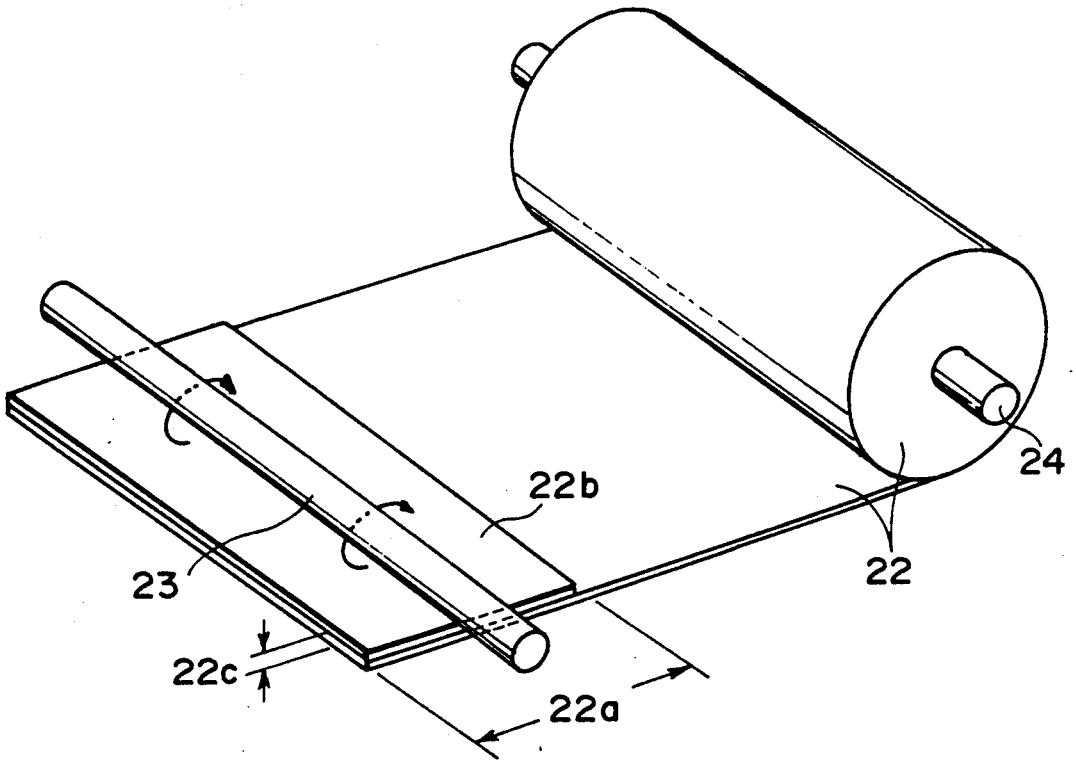
FIG. 15 is a perspective view of a rolled film, the leading edge of the fixing film is thickened.

As shown in FIG. 13, the apparatus includes an electromagnetic solenoid 41 functioning as a pressure releasing means for releasing the pressure between the heating member 21 and the pressing roller 27. When the solenoid is energized under the control of an unshown control circuit, the plunger 41*a* pulls the heating member 21 through the lever 43 and a pulling rod 44 against a pressing spring 40 away from the pressing roller 27, as shown in FIG. 14 to be separated from the pressing roller 27, so that the pressure contact between the elements 21 and 27 is released. When the solenoid 41 is deenergized, the spring 40 functions to restore the pressing state wherein they are pressed under a predetermined pressure.

On the supply shaft 24, a predetermined length of the fixing film is rolled, and the opposite ends of the shafts is detachably supported on a unshown bearing of the fixing device 20. The take-up shaft 23 is coupled with an unshown driving system of the fixing device when it is supported on the bearing and is driven in the film take-up direction.

In the pressure released state between the elements 21 and 27 by energization of the solenoid 41 to separate the heating member 21 from the pressing roller 27, the leading edge of the fixing film 22 rolled on the supply shaft 24 is pulled through the space between the heating member 21 and the pressing roller 27 which are spaced in this state. It is further pulled through the upper and lower separating rollers 25 and 29, and the leading edge is wrapped on the take-up shaft 23 and is bonded by pressure-sensitive bonding agent or the like. Then, the solenoid 41 is deenergized, by which the fixing film 22 is extended through the nip between the heating member 21 and the pressing roller 27. Now, the fixing operation can be performed.

The leading edge 22*a* of the fixing film 22 is thickened into a thick portion 22*c* by bonding an additional sheet 22*b* as shown in FIG. 8 or by applying resin liquid by dipping or the like. By doing so, the wrapping or mounting of the film on the take-up shaft 23 is made easier.

Designated by a reference 50 is a sensor arm for detecting remaining amount of the fixing film 22, which is contacted to an outer surface of the roll of the fixing film on the rewinding shaft 24. The arm 50 tilts about a shaft 50*a* in the clockwise direction when the diameter of the roll of the fixing film 22 on the rewinding shaft 24 reduces with consumption of the taking-up of the fixing film 22 to the take-up shaft 23 from the rewinding shaft 24.

When the fixing film on the rewinding shaft 24 is consumed to the neighborhood of its end by which the arm 50 reaches a predetermined angular position, the sensor 50*b* transmits to the control circuit a use-up signal of the fixing film.

In response to the signal produced, the display or warning means is operated, and the operation of the image forming apparatus is prohibited. Also, in response to the signal, the solenoid 41 is energized to release the pressure between the heating member 21 and the pressing roller 27.

The fixing film 22 is all taken-up on the take-up shaft 23 and is removed from the bearing of the fixing device together with the take-up shaft 23, and the supply shaft 22 without the fixing film is removed from its bearing and is mounted into the bearing for the take-up shaft and is reused as the take-up shaft. A fresh supply shaft having a fresh roll of the fixing film is mounted is set in the supply shaft bearing, and the leading edge of the film thereon is wrapped on the take-up shaft 23 in the manner described above, by which a fresh film is replenished.

It is a possible modification of this embodiment that the use is made with a polyimide film having good heat resistance and the mechanical strength having a thickness of 25 microns or a multi-layer film provided by coating the polyimide film with fluorine resin to increase the off-set preventing effect, and the fixing film used and taken up on the take-up shaft 27 is fed out to the supply shaft 24 and is rewound on the shaft 24 to repeatedly use the fixing film. In this rewinding type, it is preferable that by starting the film rewinding after the solenoid is energized after the film use-up is detected, the pressure between the heating member 21 and the pressing roller 27 is released during the rewinding operation.

Figure 16:
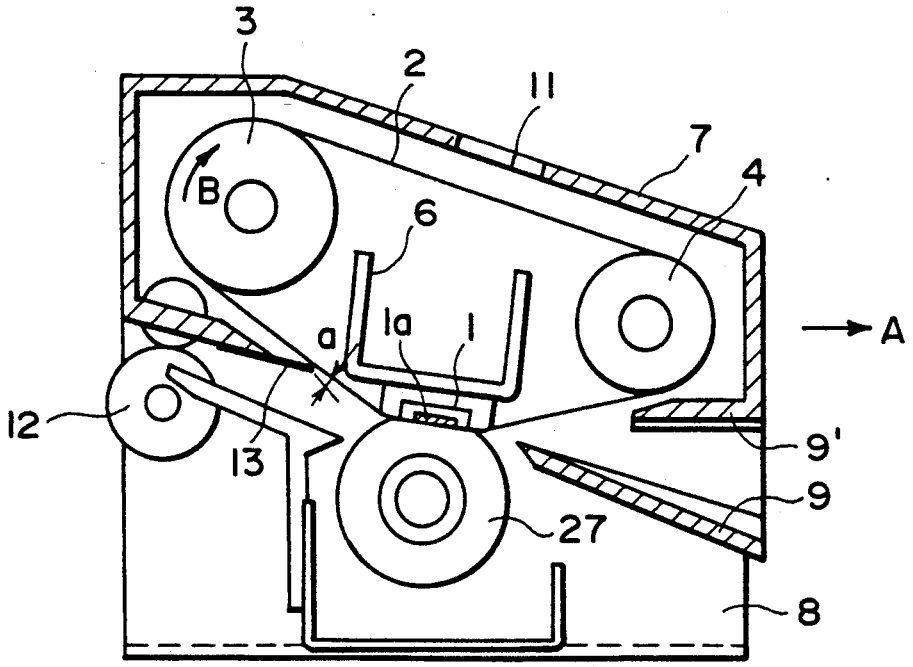
FIG. 16 is a sectional view of an image fixing apparatus according to a further embodiment of the present invention.

Referring to FIG. 16, a further embodiment will be described. A low thermal capacity linear heating member 1 comprises for example an alumina base plate having a thickness of 1 mm, a width of 10 mm and a length of 240 mm, and an electric resistance material 1*a* applied in the width of 1 mm. It is supplied with power from the opposite longitudinal ends thereof. The electric power is in the form of a pulsewise wave having a period of 20 ms of DC 100 V. The pulse width or the frequency thereof is controlled to provide a predetermined temperature using an unshown temperature detecting element.

A fixing film 2 includes heat-resistive resin such as polyimide, polyetherimide or PES resin having a thickness of approximately 20 microns, and a releasing layer may be PTFE resin or the like on one side of the film. The total thickness of the film is generally not more than 100 microns, further preferably not more than 50 microns. The fixing film is stretched between a driving roller 3 and a tension roller 4 to provide a film conveying passage in cooperation with the heating member 1. The fixing film 2 is tensioned by urging the tension roller 4 in the direction indicated by an arrow A by an unshown urging means, and is conveyed in the direction B by a driving roller.

The surface of the driving roller 3 is coated with Si rubber or the like to assure the conveyance of the film. A pressing roller 5 includes an rubber elastic layer made of silicone rubber or the like exhibiting good releasing property, which is pressed to the film heating member under the total pressure of 4–7 kg. The pressing roller 27 is supported on unshown bearings at the opposite ends thereof to be rotated following the fixing film 2.

The heating member 1 is fixed on a stay 6 having sufficient rigidity to be durable against the pressure.

The transfer sheet is introduced into the nip formed between the fixing film 2 and the pressing roller 5, and the toner image on the transfer sheet is heated and fused by the heat and pressure provided by the heat generating element 1 and the pressing roller 5 to be fixed on the transfer sheet. Thereafter, it is discharged outside the apparatus by discharging rollers 12.

In this embodiment, a heat generating element 1, the fixing film 2, the driving roller 3 and the tension roller 4 are contained in a casing 7 as a unit which is detachably mountable in the main assembly of the fixing apparatus 8 the unit constitutes a film cartridge.

Figure 17:
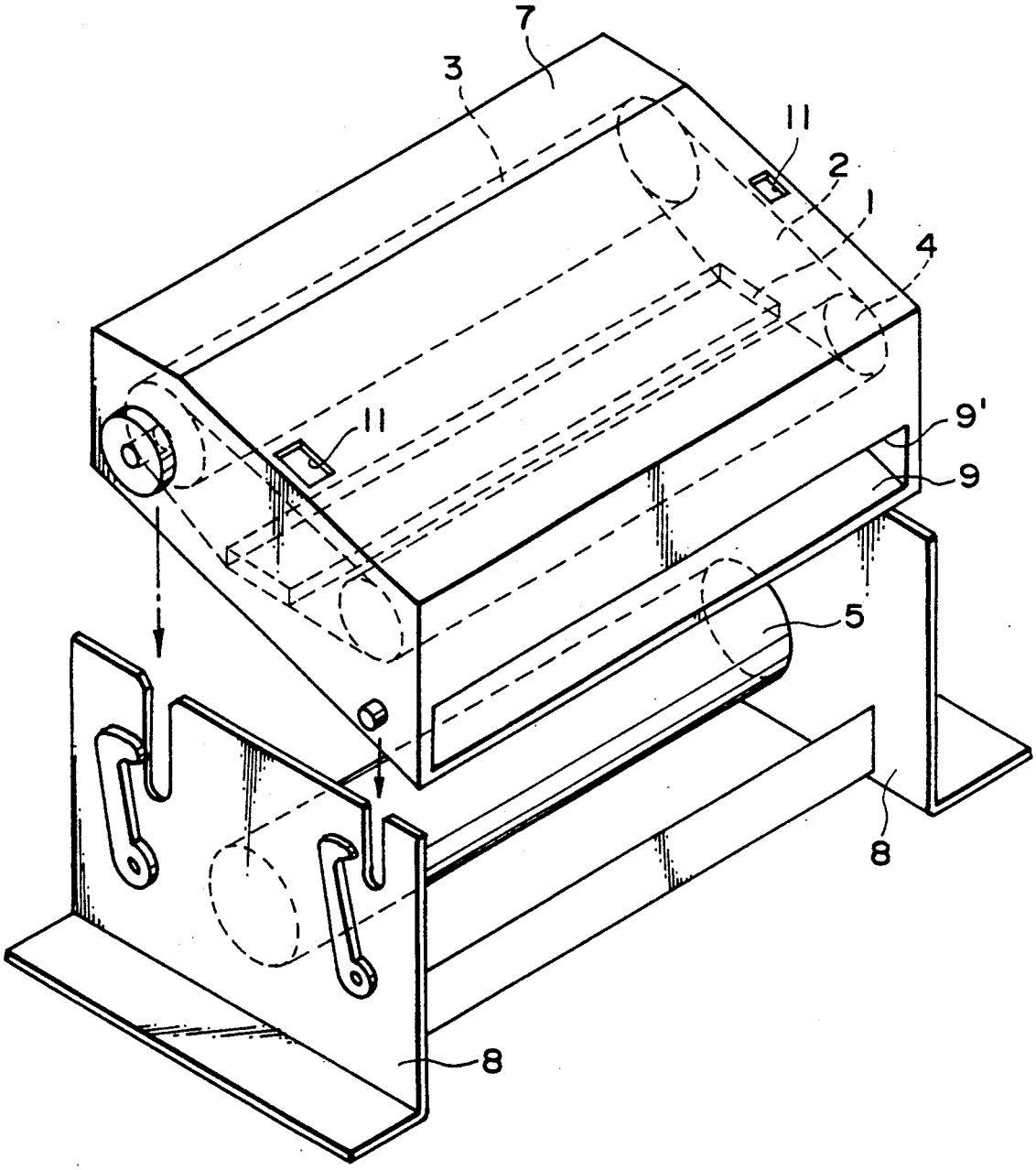
FIG. 17 is a perspective view of the image fixing apparatus of FIG. 16 embodiment.

FIG. 17 shows a perspective view of the film cartridge. The film cartridge further comprises inlet guide members 9 and 9' for introducing the transfer sheet into the nip formed between the heat generating member 1 and the pressing roller 5 and with a separating member 10 for preventing wrapping of the film in case that the transfer sheet after passing through the nip is not separated from the film.

As for the separating member, a sheet of polyimide resin or or the like is bonded to the casing 7 with a gap a from the film 2. Using this, the precision of the relative position with respect to the fixing film can be increased, and as a result, the gap with the film can be reduced, so that the guiding of the transfer sheet into the nip and separation of the transfer sheet are assured. In addition, in consideration of the fact that the inlet guides 9 and 9' and the separating member 13 are easily contaminated with toner, leading to crease production or jam occurrence, the troubles can be prevented by exchanging its together with the film.

As described hereinbefore, the fixing film 2 has a very small thickness, and therefore, it is not possible to use a flange or a crowned roller against oblique traveling of the belt. Then, the detection of the film position and the control of returning the film to the proper position are required. As for the film position detecting means, a photointerruptor of a reflection type or transmission type or a microswitch SW are usable. A window may be provided at a part of the casing 7, by which an edge of the film can be detected. The window may be covered with a transparent member, by which the heat generated by the heat generating member 1 is prevented from directly transmitted to the photointerruptor which is relatively easily influenced by heat, and therefore, the reliability and the service life is improved.

The material of the casing 7 preferably has a high heat-insulating effect as by the heat resistive resin or the like to minimize the wasteful heat transfer to use efficiently the energy. In addition, the operator can be protected from heat in consideration of the possibility that the operator in advertently contacted it during the film cartridge replacing operation or jam clearance operation or the like. For the same purpose, it is further preferable that fur materials are planted electrostatically on the outer periphery thereof.

Where different films and heating elements are prepared for the purpose of changing the fixing property or the surface property of the image after the fixing, the combinations therebetween can be freely changed with the film and the heat generating member combined as a unit, so that the service operation and latitude of the operation by the user is improved.

In this embodiment, the fixing film is in the form of an endless belt, but it may be a non-endless film.

As for the driving roller and tension roller or the like, it or they may be replaceable relative to the film cartridge to permit re-use thereof.

In the film cartridge of this embodiment, the transfer sheet conveying guide and the separating means are incorporated in the cartridge, but they may be remained in the main assembly of the fixing apparatus. It is also possible that the discharging means such as the discharging rollers or other discharging means or a part thereof may be contained in the film cartridge.

As described in the foregoing, the fixing film, the heat generating element, the driving roller or the like are constituted as a unit detachably mountable in the main assembly of the fixing apparatus. By this, the easiness of replacement of the fixing film is improved, and the possibility that the film is damaged during the jam clearance operation can be prevented. In addition, by constituting the transfer sheet guide and the separating guide as a unit, a reliability of the transfer sheet conveyance is improved.

Furthermore, since the film and the heat generating member can be replaced as a unit, the heater can be matched with the property of the film.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:
a heating source for heating a toner image;
a film movable in contact with a member for supporting the toner image, wherein the toner image is heated by heat from said heating source through said film; and
a casing forming, together with said film, a cartridge detachably mountable into said apparatus, wherein said cartridge is reversible up side down, and wherein when it is reversed, an opposite side of the film is contactable with the toner image.

2. An apparatus according to claim 1, wherein different fixing property can be provided by changing a surface of said film contactable with the toner image.

3. An apparatus according to claim 1, further comprising a driving shaft for moving said film, wherein said driving shaft is contained in said cartridge.

4. An apparatus according to claim 1, wherein said film is in the form of a non-endless film, and said film cartridge is replaced when said film is used up.

5. An apparatus according to claim 1, wherein said heating source is contained in said cartridge.

6. An image fixing apparatus, comprising:
a heating source for heating a toner image;
a film movable in contact with a supporting member for supporting the toner image, wherein the toner image is heated by heat from said heating source through said film;
wherein said film is detachably mountable into said apparatus and both sides of said film are useable for image fixing, each of said sides having a different surface roughness.

7. An image fixing apparatus, comprising:
a heating source for heating a toner image;

a film movable in contact with a supporting member for supporting the toner image, wherein the toner image is heated by heat from said heating source through said film;

wherein said film is detachably mountable into said apparatus and both sides of said film are useable for image fixing, each of said sides having the same surface property.

8. An apparatus according to claim 6 or 7, wherein said film is non-endless.

9. An apparatus according to claim 6 or 7, wherein said film is separated from the toner image after the toner image is solidified.

10. An apparatus according to claim 6 or 7, wherein said heating source is used stationarily during fixing operation, and wherein said apparatus further comprises pressing means for urging said film and the image supporting member toward said heating source.

11. An apparatus according to claim 10, wherein said heating source includes a linear heat generating layer extended in a direction crossing with a movement direction of said film.

12. An apparatus according to claim 10, wherein the urging between said heating source and said film is releasable.

13. An apparatus according to claim 11, wherein said heat generating layer is effective to heat the toner image up to a temperature sufficiently higher than a fusing point of the toner image.

14. An image fixing apparatus, comprising:

a heating source for heating a toner image;

a film movable in contact with a supporting member for supporting the toner image, wherein the toner image is heated by heat from said heating source through said film;

said film detachably mountable in said apparatus, and replaceable with another film having a different surface at a side contactable to the toner image to provide a different fixing property.

15. An apparatus according to claim 14, wherein said film is non-endless.

16. An apparatus according to claim 14, wherein said film is separated from the toner image after the toner image is solidified.

17. An apparatus according to claim 14, wherein said heating source is used stationarily during fixing operation, and wherein said apparatus further comprises pressing means for urging said film and the image supporting member toward said heating source.

18.. An apparatus according to claim 17, wherein said heating source includes a linear heat generating layer extended in a direction crossing with a movement direction of said film.

19. An apparatus according to claim 17, wherein the urging between said heating source and said film is releasable.

20. An apparatus according to claim 18, wherein said heat generating layer is effective to heat the toner image up to a temperature sufficiently higher than a fusing point of the toner image.

21. An apparatus according to claim 14, further comprising a casing forming, together with said film, a cartridge detachably mountable into said apparatus.

22. An image fixing apparatus, comprising:

a heating source for heating a toner image;

a non-endless film movable in contact with a supporting member for supporting the toner image;

wherein the toner image is heated by heat from said heating source through said film;

driving shaft for moving and sequentially taking up said film, wherein said film and said driving shaft are detachable from said apparatus as a unit;

wherein when said film is used up, an additional fixing operation is made possible by replacing said film not taken up.

23. An apparatus according to claim 22, wherein said film is separated from the toner image after the toner image is solidified.

24. An apparatus according to claim 22, wherein said heating source is used stationarily during fixing operation, and wherein said apparatus further comprises pressing means for urging said film and the image supporting member toward said heating source.

25. An apparatus according to claim 24, wherein said heating source includes a linear heat generating layer extended in a direction crossing with a movement direction of said film.

26. An apparatus according to claim 24, wherein the urging between said heating source and said film is releasable.

27. An apparatus according to claim 25, wherein said heat generating layer is effective to heat the toner image up to a temperature sufficiently higher than a fusing point of the toner image.

28. An image fixing apparatus, comprising:

a heating source for heating the toner image, said heating source used stationarily during a fixing operation;

a film movable in contact with a supporting member for supporting the toner image, wherein the toner image is heated by heat from said heating source through said film;

wherein said film is detachably mountable in said apparatus; and pressing means for imparting urging force among said heating source, said film and said supporting member;

wherein when the urging force is released, dismounting or mounting of said film is permitted.

29. An apparatus according to claim 28, wherein said film is non-endless.

30. An apparatus according to claim 28, wherein said film is separated from the toner image after the toner image is solidified.

31. An apparatus according to claim 28, wherein said heating source includes a linear heat generating layer extended in a direction crossing with a movement direction of said film.

32. An apparatus according to claim 28, wherein the urging between said heating source and said film is releasable.

33. An apparatus according to claim 29, wherein said heat generating layer is effective to heat the toner image up to a temperature sufficiently higher than a fusing point of the toner image.

34. An image fixing apparatus, comprising:

a heating source for heating a toner image;

a non-endless film movable in contact with a supporting member for supporting the toner image, wherein the toner image is heated by heat from said heating source through said film;

detecting means for detecting that said film is substantially used up; and wherein when said detecting means detects substantial use-up of said film, the fixing operation is disabled.

35. An apparatus according to claim 34, wherein said film is separated from the toner image after the toner image is solidified.

36. An apparatus according to claim 34, wherein said heating source is used stationarily during fixing operation, and wherein said apparatus further comprises pressing means for urging said film and the image supporting member toward said heating source.

37. An apparatus according to claim 36, wherein said heating source includes a linear heat generating layer extended in a direction crossing with a movement direction of said film.

38. An apparatus according to claim 36, wherein the urging between said heating source and said film is releasable.

39. An apparatus according to claim 37, wherein said heat generating layer is effective to heat the toner image up to a temperature sufficiently higher than a fusing point of the toner image.

40. An apparatus according to claim 34, wherein said fixing apparatus is used in an image forming apparatus for forming the toner image on the supporting material, and when said detecting means detects the substantial use-up of said film, operation of image forming operation of said image forming apparatus is disabled.

41. An apparatus according to claim 34, further comprising pressure imparting means for imparting urging force among said heating source, said film and said supporting member, wherein when said detecting means detects use-up of the film, the urging force by said imparting means is released.

42. An image fixing apparatus, comprising:

a heating source for heating a toner image;

a film movable in contact with a supporting material for supporting the toner image, wherein the toner image is heated by heat from said heating source through said film;

a back-up rotatable member press contacted to said film to form a nip;

a driving rotatable member for rotating in contact with said film to move said film;

wherein said heating source, said film and said driving rotatable member are detachably mountable in said apparatus as a unit without detaching said back-up rotatable member from on said apparatus.

43. An apparatus according to claim 42, wherein said film is in the form of an endless belt.

44. An apparatus according to claim 43, wherein said driving rotatable member includes a driving roller for applying moving force to said film and a follower roller rotatable following said film.

45. An apparatus according to claim 42, wherein said heating source, said film and said driving rotatable member are enclosed in a heat insulating casing.

46. An apparatus according to claim 42, wherein said heating source, said film and said driving rotatable member are enclosed by a casing which is provided with an opening for detecting a position of said film.

47. An apparatus according to claim 46, wherein a deviation of said film is controlled on the basis of detection of an end of said film through said opening.

48. An apparatus according to claim, 1, 6, 7, 16, 24, 28, 34, 42 or 45 wherein said film and the supporting material are separated from each other at a position downstream of a heating position by said heating source with respect to movement direction of the supporting material.

49. An image fixing apparatus, image fixing apparatus, comprising:

a heating source for heating a toner image;

a film movable in contact with a member for supporting the toner sheet, wherein the toner image is heated by heat from said heating source through said film; and a casing forming, together with said film, a cartridge detachably mountable into said apparatus wherein said casing is provided with an opening for detecting a position of said film.

50. An apparatus according to claim 49, wherein a deviation of said film is controlled on the basis of detection of an end of said film through said opening.

* * * * *

UNITED STATES PATENT AND TRADEMARK OFFICE
CERTIFICATE OF CORRECTION

PATENT NO. : 5,026,276

DATED : June 25, 1991

INVENTOR(S) : Hirabayashi, et al.

It is certified that error appears in the above-identified patent and that said Letters Patent is hereby corrected as shown below:

ON THE TITLE PAGE,
[56] REFERENCES CITED
U.S. PATENT DOCUMENTS,
On the first line, insert --4,566,779 1/1986 Coli et al.--.

COLUMN 1,
Line 26, delete "is".

COLUMN 2,
Line 34, "the" should read --where the--.

COLUMN 3,
Line 61, delete "being".

COLUMN 4,
Line 52 "arm 1" should read --arm 31--.

COLUMN 5,
Line 47, "passes" should read --pass--.

COLUMN 6,
Line 35, "is" should read --, which is--.

COLUMN 8,
Line 1, "the" (first occurrence) should read --whereby the--;
Line 2, "first" should read --is first--, and "fused" should read --then fused--; and
Line 68, "film." should read --film follows.--.

UNITED STATES PATENT AND TRADEMARK OFFICE

CERTIFICATE OF CORRECTION

PATENT NO. : 5,026,276

DATED : June 25, 1991

INVENTOR(S) : Hirabayashi, et al.

It is certified that error appears in the above-identified patent and that said Letters Patent is hereby corrected as shown below:

COLUMN 10,
Line 22, "side" should read --sides--;
Line 25, "of" should read --is--; and
Line 67, delete "is".

COLUMN 11,
Line 39, "cartridge" should read --cartridges--.

COLUMN 12,
Line 50, "roller 22" should read --roller 27--.

COLUMN 13,
Line 15, "bears 67" should read --gears 67--;
Line 18, "A" should read --An--; and
Line 65, "take-up" should read --taken-up--.

COLUMN 14,
Line 45, "he" should read --the--;
Line 57, "tens" should read --tends--; and
Line 63, "has" should read --as--.

COLUMN 16,
Line 17, "22" should read --24--;
Line 31, "shaft 27" should read --shaft 23--; and
Line 66, "roller 5" should read --roller 27--.

COLUMN 17,
Line 7, "roller 5" should read --roller 27--;
Line 10, "roller 5" should read --roller 27--; and
Line 17, "8 the" should read --8. The--.

UNITED STATES PATENT AND TRADEMARK OFFICE

CERTIFICATE OF CORRECTION

PATENT NO. : 5,026,276

DATED : June 25, 1991

INVENTOR(S) : Hirabayashi, et al.

It is certified that error appears in the above-identified patent and that said Letters Patent is hereby corrected as shown below:

COLUMN 18,

Line 43, "up side" should read --upside--.

COLUMN 22,

Line 6, delete "on";

Line 29, delete "image fixing appara-" (second occurrence); and

Line 30, delete "tus,".

Signed and Sealed this

Twenty-third Day of February, 1993

*Attest:*

*Attesting Officer*

STEPHEN G. KUNIN

*Acting Commissioner of Patents and Trademarks*